US011858591B2

(12) United States Patent
Ekern et al.

(10) Patent No.: US 11,858,591 B2
(45) Date of Patent: Jan. 2, 2024

(54) SIDE SHADE ASSEMBLY

(71) Applicants: MasterCraft Boat Company, LLC, Vonore, TN (US); Apex Canvas Co., LLC, Loudon, TN (US)

(72) Inventors: David F. Ekern, Knoxville, TN (US); Chad A. Lynema, Knoxville, TN (US); Joseph Hamilton, III, Lenoir City, TN (US); Jon Broncatello, Knoxville, TN (US); Gary W. Campbell, Knoxville, TN (US)

(73) Assignee: MasterCraft Boat Company, LLC, Vonore, TN (US)

( * ) Notice: Subject to any disclaimer, the term of this patent is extended or adjusted under 35 U.S.C. 154(b) by 226 days.

(21) Appl. No.: 17/386,909

(22) Filed: Jul. 28, 2021

(65) Prior Publication Data

US 2022/0348292 A1 Nov. 3, 2022

Related U.S. Application Data

(60) Provisional application No. 63/183,412, filed on May 3, 2021.

(51) Int. Cl.
*B63B 17/02* (2006.01)

(52) U.S. Cl.
CPC ..... *B63B 17/02* (2013.01)

(58) Field of Classification Search
CPC ..... B63B 17/00; B63B 17/02
USPC ..... 114/361
See application file for complete search history.

(56) References Cited

U.S. PATENT DOCUMENTS

| | | | | |
|---|---|---|---|---|
| 2,542,586 | A | 2/1951 | Skjeveland | |
| 6,711,783 | B2 | 3/2004 | LeMole | |
| 6,848,387 | B1 * | 2/2005 | Zalanka | B63B 17/02 114/361 |
| 6,978,731 | B2 | 12/2005 | Erbetta | |
| 8,056,495 | B2 | 11/2011 | Lemons | |
| 9,637,203 | B1 | 5/2017 | Kirwan-Waterson | |
| 9,909,617 | B1 | 3/2018 | Prey | |
| 10,035,565 | B1 | 7/2018 | Kirwan-Waterson | |
| 10,597,119 | B1 | 3/2020 | Lambert et al. | |
| 2006/0237617 | A1 | 10/2006 | Dwello | |
| 2007/0144425 | A1 | 6/2007 | Buckley | |

(Continued)

FOREIGN PATENT DOCUMENTS

KR 10-0926452 B1 11/2009

OTHER PUBLICATIONS

Jet Boaters Community Forum, "Bimini Side Shade"; www.jetboaters.net/threads/bimini-side-shade. 13113/; last visited May 18, 2020.

(Continued)

*Primary Examiner* — Lars A Olson
(74) *Attorney, Agent, or Firm* — Venable LLP

(57) ABSTRACT

A boat includes a bow and a stern, a deck between the bow and the stern, a longitudinal centerline extending from the bow to the stern dividing the deck into a port side and a starboard side, and a side shade assembly attached to the boat on one of the port side of the deck and the starboard side of the deck. The side shade assembly includes a frame and a side shade cover supported by the frame such that the side shade cover extends outboard beyond the deck in a direction away from the longitudinal centerline.

20 Claims, 21 Drawing Sheets

(56) References Cited

U.S. PATENT DOCUMENTS

| | | | |
|---|---|---|---|
| 2011/0155197 | A1 | 6/2011 | Hicks et al. |
| 2014/0178123 | A1 | 6/2014 | Hamilton et al. |
| 2020/0108897 | A1 | 4/2020 | Shearer |

OTHER PUBLICATIONS

Blackstick, "Carbon Fiber Break Down Rob Holder Shade Pole", www.theblackstick.com/rod-holder-shade-pole; last visited May 18, 2020.

Rowland Street Boat Trimmers, "D.I.Y. Kitset Biminis", www.boatcovers.com.au/page/diy_kitset_biminis; last visited May 18, 2020.

Custom T-Top Covers for Boats, "T-Top Boat Shade Kit", https://ttopcoversforboats.com/product/productproductproductt-top-boat-shade-kit-resilience/; last visited May 18, 2020.

* cited by examiner

SIDE SHADE ASSEMBLY

TECHNICAL FIELD

This invention relates to shade covers for boats.

BACKGROUND

Shade covers, such as bimini tops, are useful to provide protection to passengers on a boat from the elements, such as the sun and rain. When used on boats, the shade covers typically provide shade coverage when the sun is directly overhead, but do not provide shade coverage for low angles of the sun, such as during the morning and the late afternoon/evening. During such hours, glare from the sun may impede visibility, and the temperature may still be quite hot.

SUMMARY

According to an embodiment, a boat includes a bow and a stern, a deck between the bow and the stern, a longitudinal centerline extending from the bow to the stern dividing the deck into a port side and a starboard side, and a side shade assembly attached to the boat on one of the port side of the deck and the starboard side of the deck. The side shade assembly includes a frame and a side shade cover supported by the frame such that the side shade cover extends outboard beyond the deck in a direction away from the longitudinal centerline.

According to another embodiment, a shade assembly, for a boat having a deck, includes a frame that is capable of attaching to the boat such that the frame extends outboard from the boat, a top shade cover supported by the frame and disposed directly above at least a portion of the deck of the boat, and a side shade cover supported by the frame and attached to the top shade such that the side shade cover extends outboard in a direction away from the top shade cover when the frame is attached to the boat.

Additional features, advantages, and embodiments of the present disclosure are set forth or apparent from consideration of the following detailed description, drawings, and claims. Moreover, it is to be understood that both the foregoing summary and the following detailed description are examples and intended to provide further explanation without limiting the scope of the disclosure as claimed.

BRIEF DESCRIPTION OF THE DRAWINGS

The foregoing and other features and advantages will be apparent from the following, more particular, description of various embodiments, as illustrated in the accompanying drawings, wherein like reference numbers generally indicate identical, functionally similar, and/or structurally similar elements.

FIGS. 14A-14C are cross-sectional views taken along section line 11-11 in FIG. 10. FIG. 14A shows a first step in installing the side shade assembly. FIG. 14B shows a second step in installing the side shade assembly. FIG. 14C shows a third step in installing the side shade assembly.

DETAILED DESCRIPTION

Various embodiments are discussed in detail below. While specific embodiments are discussed, this is done for illustration purposes only. A person skilled in the relevant art will recognize that other components and configurations may be used without departing from the spirit and scope of the present disclosure.

In this disclosure and claims, various ranges are identified. Unless context or language indicates otherwise, these ranges include the end points and all the sub-ranges contained therein.

Figure 1:
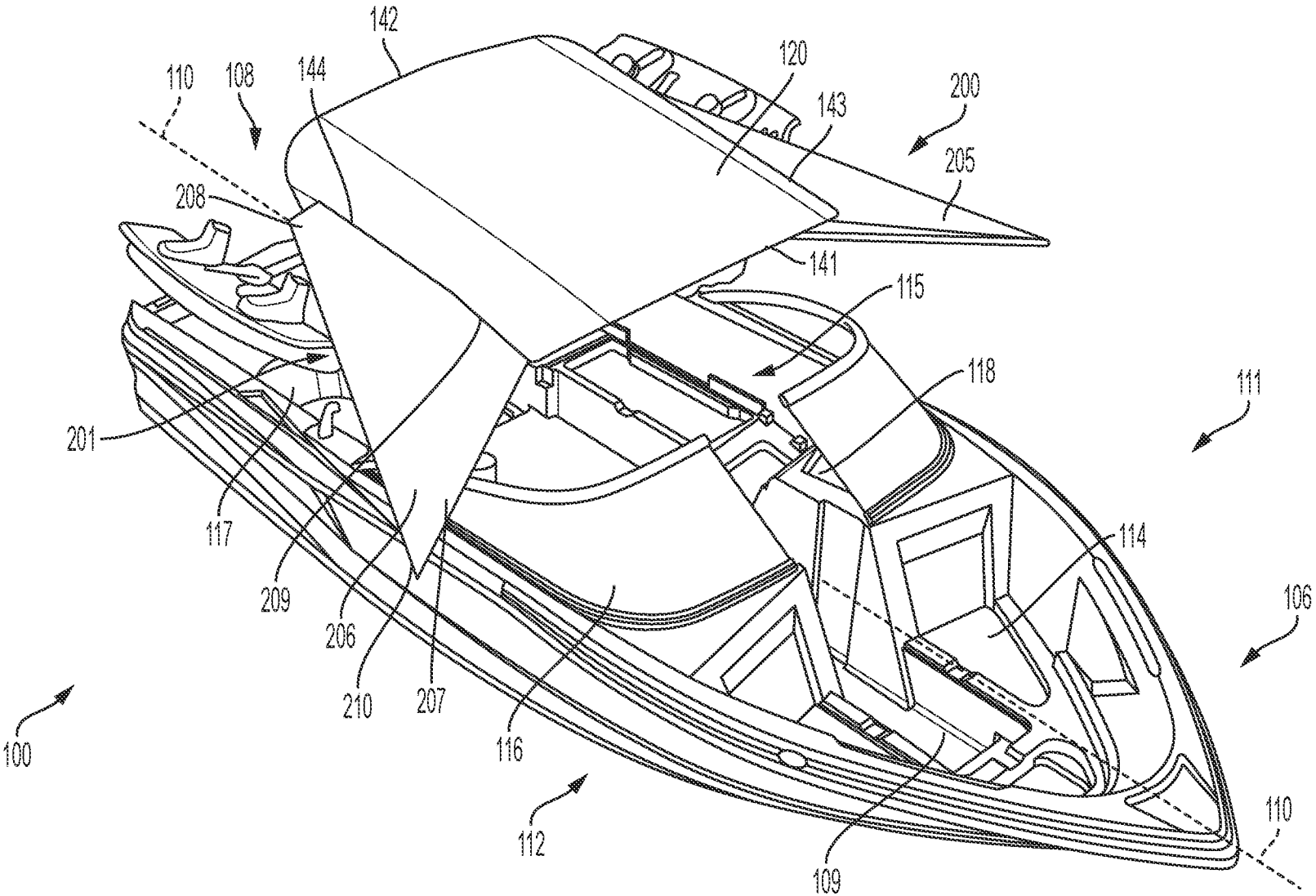
FIG. 1 shows a perspective view of a boat having a side shade assembly on each of the port and starboard sides.

FIG. 1 is a perspective view of a boat 100 having a side shade assembly 200. The boat 100 includes a bow 106, a stern 108, and a deck 109 between the bow 106 and the stern 108. The boat 100 also has a longitudinal centerline 110 extending from the bow 106 to the stern 108, which divides the boat 100 and the deck 109 into a port side 111 and a starboard side 112. As used herein, directional terms forward (fore), aft, inboard, and outboard have their commonly understood meaning in the art. Relative to the boat 100, forward is a direction toward the bow 106, and aft is a direction toward the stern 108. Likewise, inboard is a direction toward the longitudinal centerline 110 of the boat and outboard is a direction away from the longitudinal centerline 110. Similarly, port is a direction towards the port side 111 and starboard is a direction towards the starboard side 112.

Figure 2:
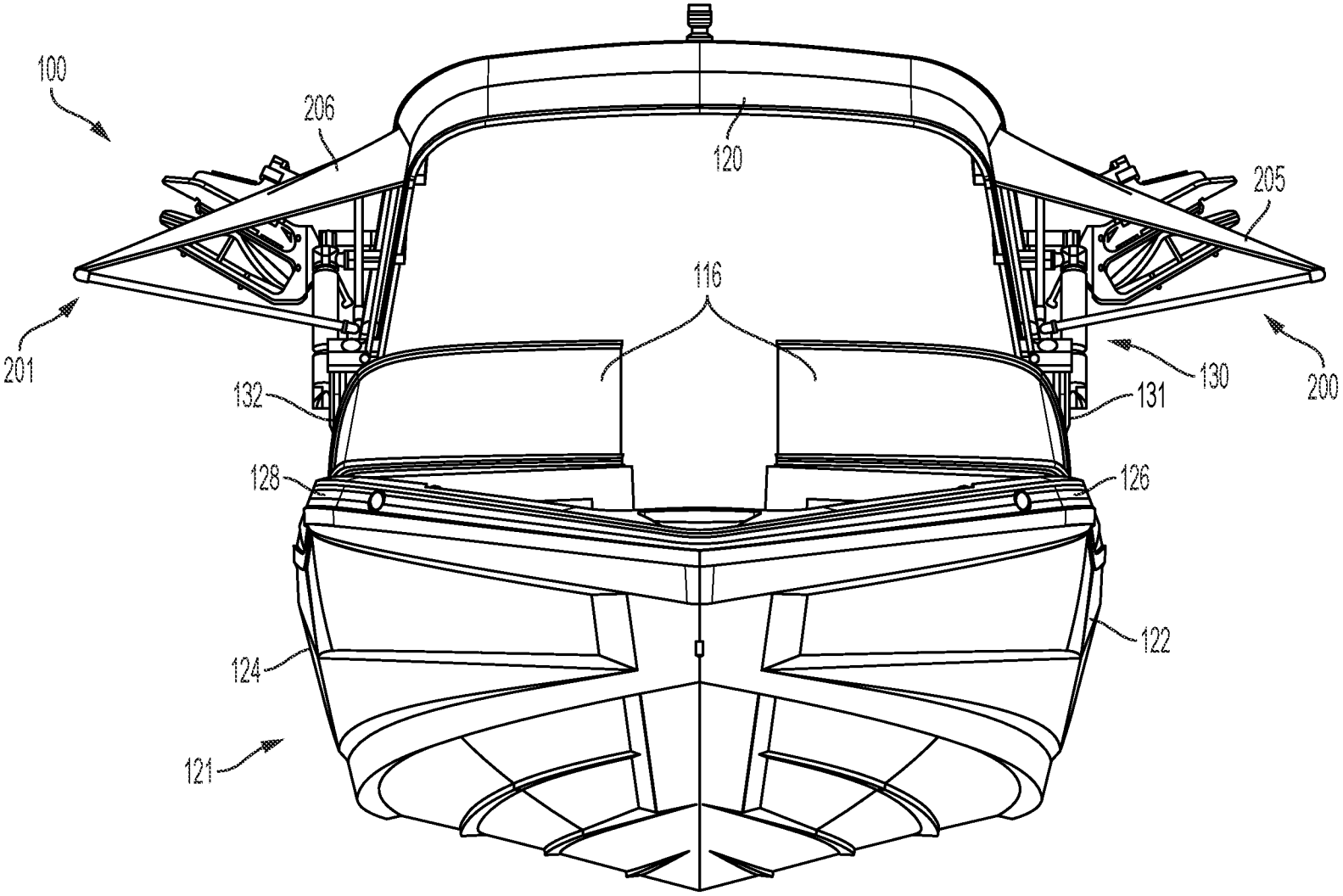
FIG. 2 shows a front view of the boat shown in FIG. 1.
Figure 3:
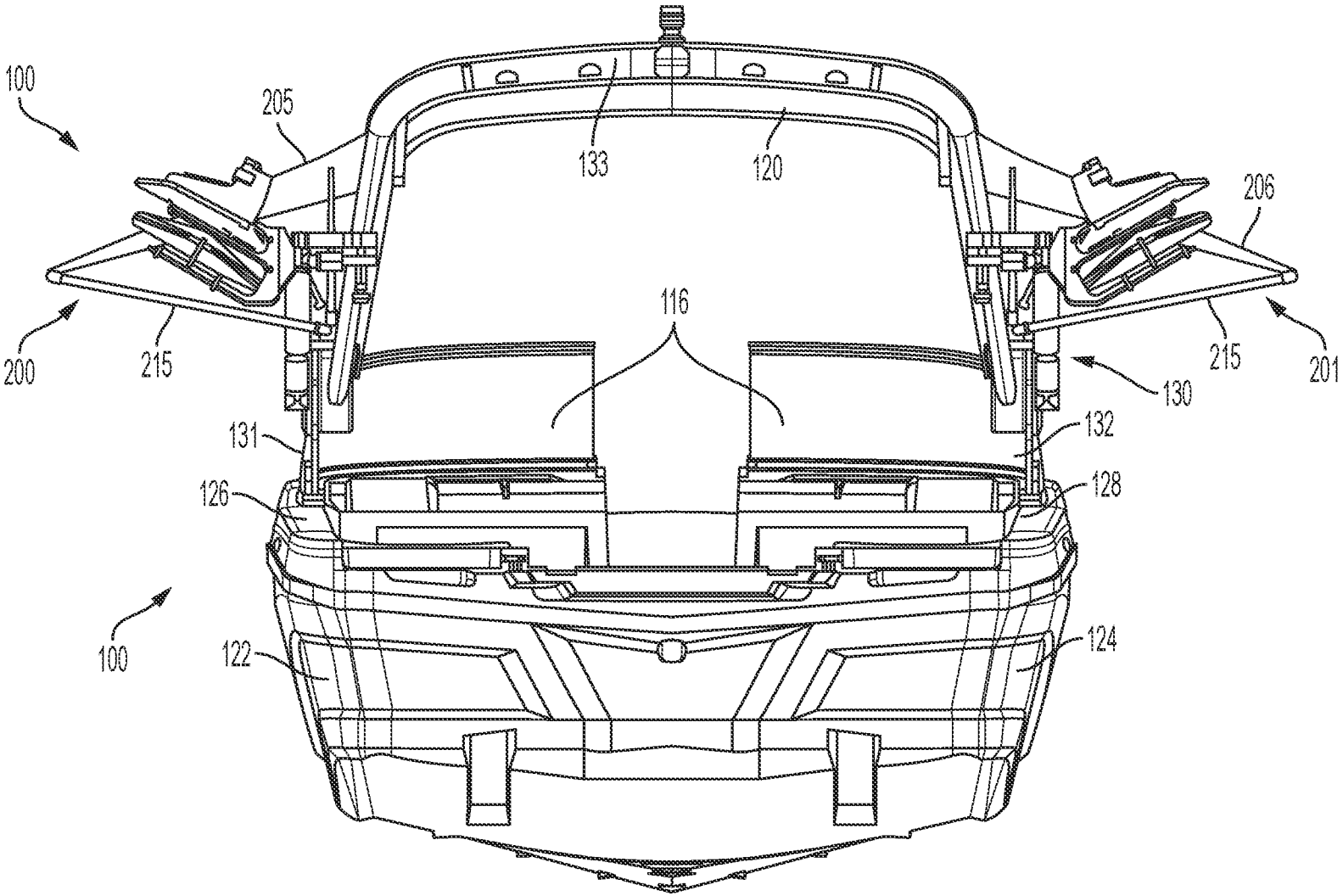
FIG. 3 shows a rear view of the boat shown in FIG. 1.
Figure 4:
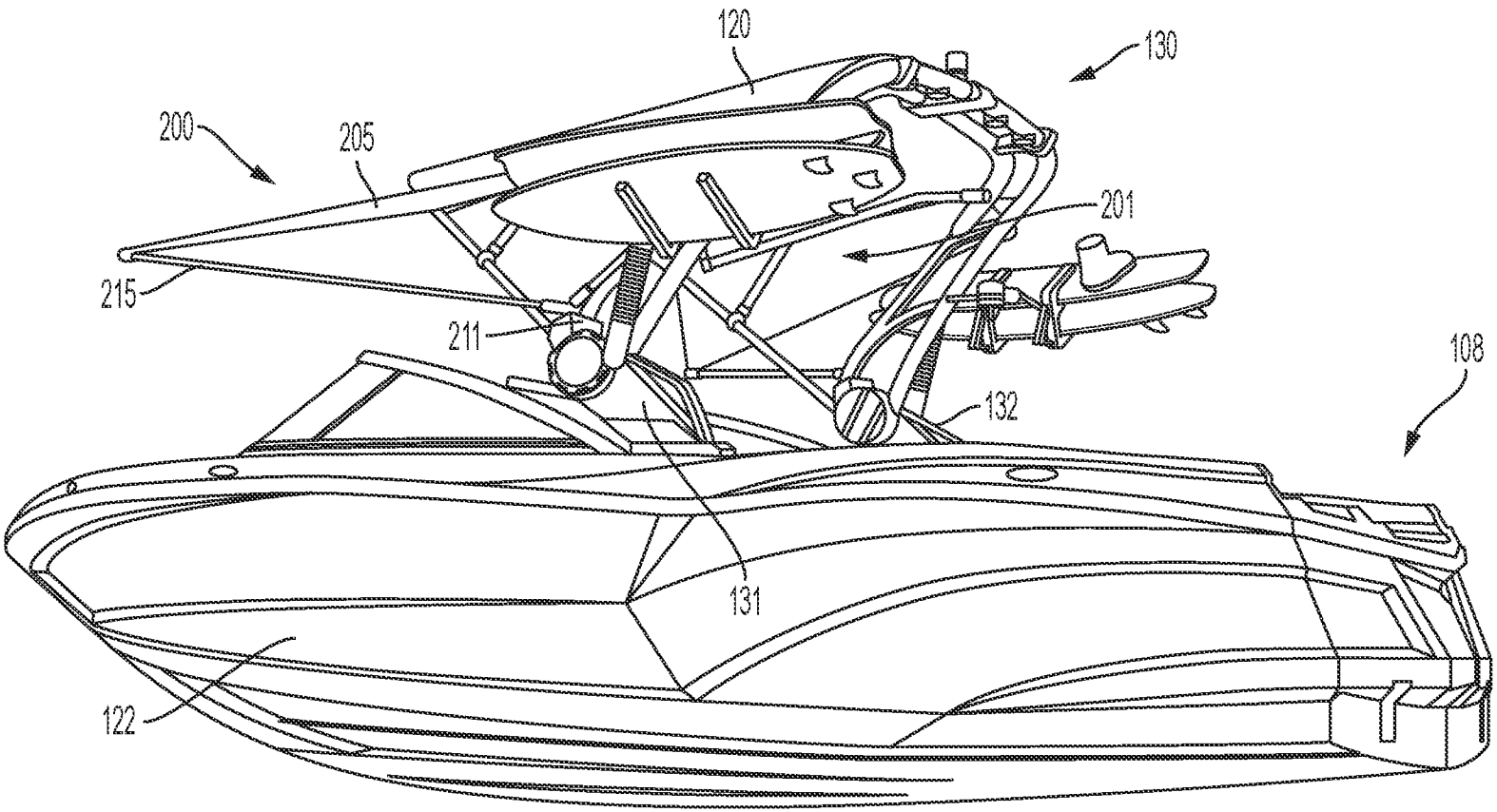
FIG. 4 shows a perspective view of the port side of the boat shown in FIG. 1.

The side shade assembly 200 includes a side shade cover 205 attached to the port side 111 of the boat 100. The side shade cover 205 provides cover to passengers from low angles of the sun. In this embodiment, there is another side shade assembly 201 shown in FIG. 1 with another side shade cover 206 on the starboard side 112. FIGS. 2 and 3 show front and rear views, respectively, of the boat in FIG. 1, and FIG. 4 shows a perspective view of the port side of the boat 100 in FIG. 1. While the following discussion generally references the side shade assembly 200 and side shade cover 205 on the port side 111, the discussion equally applies to the side shade assembly 201 and side shade cover 206 on the starboard side 112.

The boat 100 has a hull 121, which includes the bow 106, the stern 108, a port hull side 122, and a starboard hull side 124. The port hull side 122 and the starboard hull side 124 of the hull 121 may have a port gunwale 126 and a starboard gunwale 128, respectively, that rise above the level of the deck 109 along the edges of the boat 100 on the port hull side 122 and the starboard hull side 124, respectively. Other boat types, such as pontoon boats, for example, have a fence, a railing, or another type of safety barrier along the edge of the deck 109. The boat 100 may have one or more cleats 442, 443 (see FIG. 15) attached to the boat 100, and more specifically to the hull 121, the port hull side 122, the starboard hull side 124, the port gunwale 126, and/or the starboard gunwale 128. Alternatively, the cleats 442, 443 may be attached to the deck 109 or, for a pontoon boat, to a fence or a railing. The cleats 442, 443 facilitate tying the boat 100 to a dock and securing other equipment or objects to the boat 100.

In the boat 100 shown in FIG. 1 is a bow rider driven by a single inboard motor connected to a propeller by a drive shaft. Although the side shade assembly 200 is shown and described with reference to a bow rider, the side shade assembly 200 is applicable to any suitable type of boat, including cuddies, center consoles, pontoon boats, and cruisers, for example. Likewise, the boat 100 may use other propulsion systems, including but not limited to outboard motors, jet drives, stern drives, and the like.

The boat 100 includes one or more seating areas for passengers. Any suitable type of seating area may be used, including, for example, those described in U.S. Patent Application Publication Nos. 2020/0130786 and 2018/0314487, which are incorporated by reference herein in their entireties. In the embodiment shown in FIG. 1, the boat 100 is a bowrider with a bow seating area 114 positioned in the bow 106 of the boat 100. The boat 100 also has a primary seating area 115 (sometimes also referred to as the cockpit) positioned aft of a windshield 116. In addition, the boat 100 includes a stern seating area 117, which may be configured in a forward-facing configuration or an aft-facing seating configuration. Additionally, the primary seating area 115 includes a control console 118 for operating the boat 100. The control console 118 can be positioned in the cockpit on either the port side 111 or the starboard side 112 of the boat 100 proximate to and aft of the windshield 116. Other types of boats, including cuddies, center consoles, pontoon boats, paddle boats, and cruisers, for example, may have one or more of the seating areas 114, 115, 117, as well as additional different seating areas.

As shown in FIG. 2, the boat 100 has a tower 130, which may be used for towing a water sports participant, storing water sports equipment, and/or supporting other accessories. Any suitable type of tower may be used including, for example, those described in U.S. Pat. Nos. 9,580,155; 6,539,886; and 10,150,540, which are incorporated by reference herein in their entireties. The tower 130 may be supported by one or more vertical supports. For example, the tower 130 may be supported by one or both of a port leg 131 and a starboard leg 132 on the port side 111 and the starboard side 112 of the boat 100, respectively. In some embodiments, a lower portion of the port leg 131 and the starboard leg 132 may be attached to the port gunwale 126 and the starboard gunwale 128, respectively, using any suitable means including, for example, bolts, fasteners, welding, and the like. In some embodiments, such as the example of the boat 100 depicted in FIGS. 1 through 4, the port leg 131 and the starboard leg 132 are mirror images of each other. In other embodiments, the port leg 131 and the starboard leg 132 may have an asymmetric construction.

As shown in FIG. 3, the tower 130 may include a header 133, which is connected to upper portions of the port leg 131 and/or the starboard leg 132 and spans the deck 109 of the boat 100 at a height suitable for passengers to pass underneath while standing. The header 133 may be attached to the port leg 131 and/or the starboard leg 132 using any suitable means including, for example, bolts, fasteners, welding, and the like, or may be integrally formed with the upper portion of the port leg 131 and/or the upper portion of the starboard leg 132. For example, when aluminum tubing is used for both the upper portion of the port leg 131, the starboard leg 132, and the header 133, all three of these components may be formed by bending a single piece of aluminum tubing.

The tower 130 provides a location on which to mount a top shade cover 120 to protect the occupants of the boat 100 from the elements (e.g., sun, rain, etc.). Any suitable type of top shade cover may be used including, for example, the bimini top described in U.S. Pat. No. 10,286,982, which is incorporated herein by reference in its entirety. The top shade cover 120, which also may be referred to as a bimini top or a bimini, may be movable between a stowed position and a deployed position. For example, the top shade cover 120 may be a weather-proof or weather-resistant canvas, which may be rolled up or folded in the stowed position when not in use. In this example, the top shade cover 120 is supported by a bimini frame 140, which may be pivotally attached to the port leg 131 and the starboard leg 132. The bimini frame 140 pivots about this attachment to move between the stowed position and the deployed position, causing the top shade cover 120 to fold out of the way in the stowed position and to extend over the deck 109 in the deployed position.

Alternatively, the top shade cover 120 may be a hard-top cover. The hard-top cover may be a plastic, metal, or other rigid material that is waterproof, at least partially opaque to light, and may be protective against ultraviolet radiation. In such embodiments, the hard-top cover may be a stand-alone cover with vertical supports for support above the deck 109. These vertical supports may be mounted to one or more of the port gunwale 126, the starboard gunwale 128, the tower 130 (e.g., the port leg 131 and/or the starboard leg 132), and the deck 109.

Figure 5:
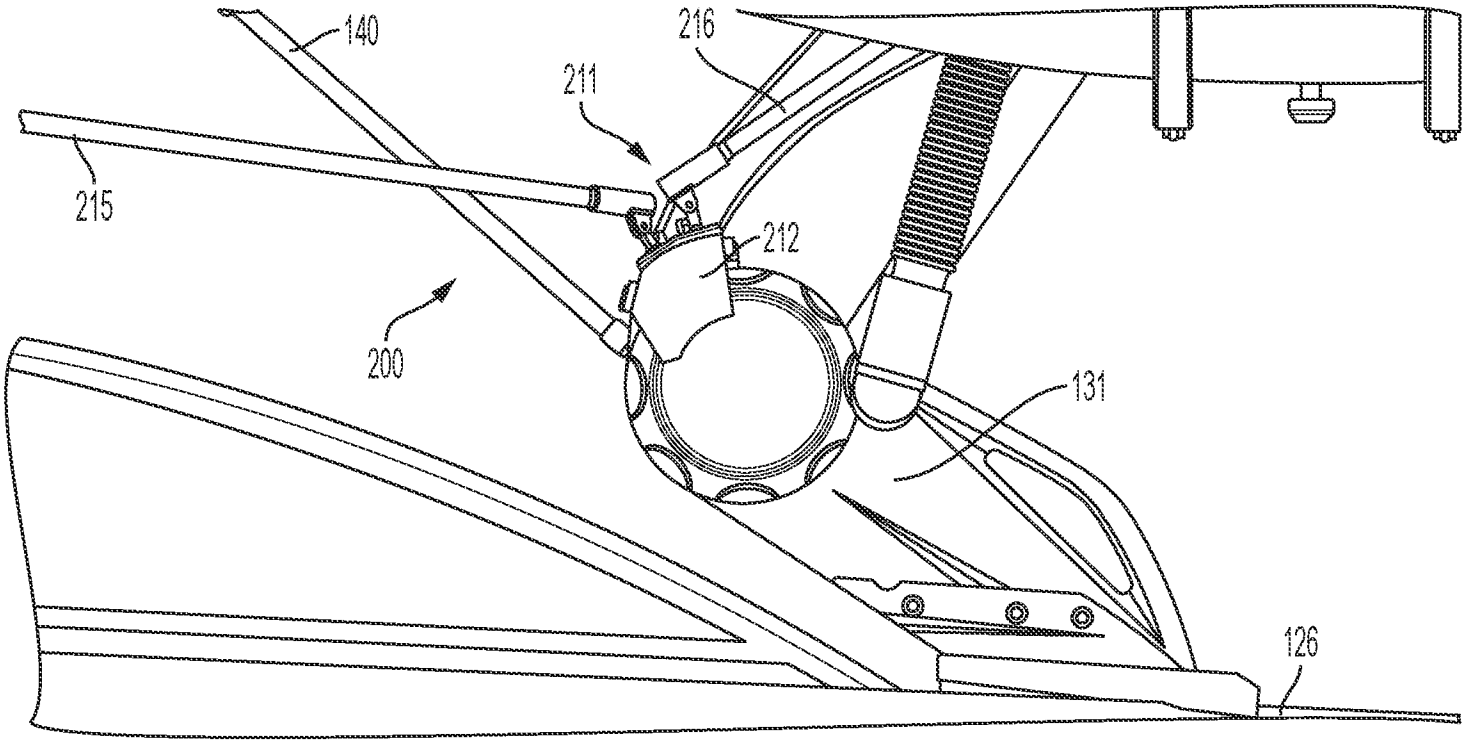
FIG. 5 is a detail view of a port leg of a tower of the boat shown in FIG. 1, showing a support frame of the side shade assembly.

For the boat 100 showing in FIGS. 1 through 4, the top shade cover 120 discussed above is mounted to and supported by a bimini frame 140 with vertical and transverse supports, which is attached to the tower 130 (e.g., as shown in FIG. 5). The vertical supports of such a bimini frame 140 support the top shade cover 120 above the deck 109, and the transverse supports support the top shade cover 120 between the vertical supports over the deck 109.

The top shade cover 120 alternatively may be mounted in other locations. For example, the top shade cover 120 may be used on boats without a tower 130, as a stand-alone bimini. The vertical supports of the bimini frame 140 would then be mounted directly to the port gunwale 126, the starboard gunwale 128, and/or to the deck 109. The top shade cover 120 covers at least a portion of the deck 109. For example, the top shade cover 120 may be positioned directly over one or more of the seating areas of the boat 100, such as the bow seating area 114, the primary seating area 115 (including the control console 118), and the stern seating area 117. For types of boats other than the bowrider shown in FIGS. 1 through 4, the top shade cover 120 may be positioned to cover, at least partially, other types of seating areas.

The top shade cover 120 shown in FIG. 1 has a forward edge 141, an aft edge 142, a port edge 143, and a starboard edge 144, due to its rectangular shape, though other shapes with fewer or more edges can be used. The top shade cover 120 may extend over at least a majority (e.g., greater than 50%) of the primary seating area 115. For example, in some embodiments, the top shade cover 120 extends over the entire extent of the primary seating area 115 forward of the tower and including the control console 118. Although the aft edge 142 in this embodiment is positioned over the forward portion of the primary seating area 115, it is not so limited. In other embodiments, the aft edge 142 may be positioned so as to cover the entirety of the primary seating area 115, or may even be positioned over the stern seating area 117, in such a manner that the top shade cover 120 also provides cover to at least a portion of the stern seating area 117. Likewise, the forward edge 141 may be positioned over the bow seating area 114, in such a manner that the top shade cover 120 also provides cover to at least a portion of the bow seating area 114.

The top shade cover 120 may extend over at least a majority of the width of the boat 100 over the seating areas, and more preferably over the entire width of the boat 100 from the port hull side 122 to the starboard hull side 124. Based on the distance of the port edge 143 and the starboard edge 144 relative to the longitudinal centerline 110, the top shade cover 120 may extend over the full beam width of the boat 100, or over a portion of the full beam width, as measured at widest extent from the port side 111 to the starboard side 112. For example, if the port edge 143 and the starboard edge 144 are positioned above the port gunwale 126 and the starboard gunwale 128, respectively, then the top shade cover 120 provides cover to the full beam width of the boat 100. In some embodiments where the top shade cover is not rectangular, the distance from the port edge 143 and the starboard edge 144 to the longitudinal centerline 110 may vary depending on position along the longitudinal centerline 110, so that the top shade cover 120 does not provide equal cover to the boat 100 from the aft edge 142 to the forward edge 141.

As discussed, the top shade cover 120 is positioned in some embodiments directly above one or more of the seating areas 114, 115, 117 (including control console 118) of the boat 100. While the top shade cover 120 provides shade to passengers seated in the seating areas 114, 115, 117 when the sun has a high angle, there are hours (e.g., at some latitudes, from 9:00 to 11:00 in the morning, and from 6:00 to 8:00 in the evening) when the sun is low enough that the top shade cover 120 does not provide adequate shade to the passengers. During such hours, it still can be quite hot and there can still be substantial ultraviolet exposure, so shade from the sun is desirable. To provide coverage during these hours, the side shade cover 205 is positioned outboard beyond the deck 109, to create shade for one or more of the seating areas 114, 115, 117. After deployment of side shade cover 205, one or more of the seating areas 114, 115, 117 are at least partially covered at an angle.

The side shade cover 205 may have various geometries including those that have multiple edges. The side shade cover 205 may, for example, be generally triangular having three corners, such as the side shade cover shown in FIGS. 1 through 4. The side shade cover alternatively may have a quadrilateral shape having four corners, such as a trapezoidal shape (see FIG. 10) or the shapes shown in FIGS. 18A and 18B. When extended in position to provide shade to the seating areas 114, 115, 117, the side shade cover 205 may have a leading edge 207 positioned closer to the bow 106 and a trailing edge 208 positioned closer to the stern 108. In addition, the side shade cover 205 may have an inboard edge 209 and an outboard edge 210. The side shade cover 205 may be positioned to provide shade to any single one or any combination of the seating areas 114, 115, 117.

In the example of FIG. 1, the leading edge 207 of the side shade cover 205 is positioned closer to the bow 106 than the forward edge 141 of the top shade cover 120. In other embodiments, such as the example of FIG. 10 and FIG. 15, the trailing edge 208 of the side shade cover is positioned closer to the stern 108 than the aft edge 142 of the top shade cover 120. The positions of the leading edge 207 and the trailing edge 208 of the side shade cover 205 may be varied to provide different levels of cover to the bow seating area 114, the primary seating area 115, and the stern seating area 117.

In some embodiments, the side shade cover 205 is attached to the top shade cover 120. The port edge 143 and the starboard edge 144 of the top shade cover 120 also may provide attachment points for the side shade cover 205. For example, the side shade cover 205, which is on the port side 111 of the boat 100, may attach to at least the port edge 143 of the top shade cover 120 along at least the inboard edge 209 of the side shade cover 205, and in some cases also at least partially along the leading edge 207 and the trailing edge 208 of the side shade cover 205, to provide continuous shade and cover to portions of the seating areas 114, 115, 117 with the top shade cover 120. Likewise, the side shade cover 206, which is installed on the starboard side 112 of the boat 100, may attach to at least the starboard edge 144 of the top shade cover 120 along at least the inboard edge 209 of the side shade cover 206.

The side shade cover 205 may be attached to the top shade cover 120 with a fastener, such as a zipper, along at least a portion of at least one edge of the top shade cover 120 (such as the port edge 143). The use of a fastener allows the side shade cover 205 to be detachably connected to the top shade cover 120. Alternatively, the side shade cover 205 and the top shade cover 120 may be a single piece of material, with the side shade cover 205 stowed by rolling or folding when not in use. In some embodiments, such as when the top shade cover 120 is a hard-top, the side shade cover 205 may be a retractable roller shade, which retracts into and extends out of the top shade cover 120.

In the example of FIG. 1, the side shade cover 205 and the top shade cover 120 are made of a weather-proof or weather-resistant canvas, which can be rolled or folded to fill a compact volume in a stowed position. Canvas is a suitable material, due to providing weather-proof protection from rain and water, and being opaque enough to provide sufficient shade and ultraviolet protection from the sun. Another suitable material is PhiferTex®, made by Phifer, Inc. of Tuscaloosa, Ala., or other similar materials with a mesh construction that block a percentage of light (e.g., 50% to 75%) and also provide ultraviolet protection. Such mesh-type materials permit airflow through the material, which is advantageous in preventing a parachute effect when the boat 100 is underway.

Those skilled in the art, however, will recognize that any material suitable for use in an outdoor marine environment and having other suitable characteristics for performing some or all of the functions discussed, as well as other functions (for example, strength, wear resistance, etc.), may be used. Suitable materials include, but are not limited to, canvas, stainless steel, plastic, fiberglass, metal, PhiferTex®, and/or any combination of these and other suitable materials.

When deployed outboard, the side shade cover 205 may incline upwards or downwards from its attachment point to the top shade cover 120. In some cases, the height of the side shade cover 205 above the deck 109 may vary along the longitudinal centerline 110. The height of the side shade cover 205 may be adjusted to provide shade at a variety of angles of the sun relative to the horizon, and may be adjusted to provide different amounts of shade to the seating areas 114, 115, 117. The farthest outboard edge of the side shade cover 205 may have a vertical height above the deck in line with the eye level of a seated passenger, or higher, in order to provide protection along the waterline from the sun at very low angles.

In embodiments where the side shade cover 205 has a triangular shape, at least two of the leading edge, trailing edge, inboard edge, and outboard edge may be the same edge. In embodiments where the side shade cover 205 has a quadrilateral shape, the leading edge, the trailing edge, the inboard edge, and the outboard edge may all be different edges. The edges of the generally triangular shape and the quadrilateral shape are not limited to rectilinear edges, but may instead have curved edges (e.g., the port and starboard side shade covers 405, 406 shown in FIGS. 18A and 18B). In some embodiments, the side shade cover 205 has a custom shape adapted for the specific shape of the boat 100, and in such embodiments may have different shapes for the port side 111 and the starboard side 112. For example, a side shade cover 205 intended for installation on the port side 111 may be a mirror image of a side shade cover 206 on the starboard side 112. Other embodiments may have shapes with more than four edges or four corners. The shape of the side shade cover 205 may be varied to avoid interfering with other equipment on the boat 100, such as board racks, tow lines, and other accessories mounted to the tower 130.

The position of the side shade cover 205 can be adjusted at a downwards angle to increase shade coverage from the sun, but not so low that seated occupants in the boat cannot see below the side shade cover 205 and outside the boat 100 towards the horizon. Due to the outboard deployment and downward angle, the side shade cover 205 permits visibility towards the horizon with a far larger field of view than a curtain that is only vertical (e.g., a side curtain). In order to provide effective shade, the side shade cover 205 may be at least partially opaque. The downward angle allows for an unobstructed field of view towards the horizon and for ventilation, without sacrificing the ability to provide shade.

As shown in FIG. 4, the side shade assembly 200 includes a support frame 211. The support frame 211 supports the side shade cover 205 for mounting and secure attachment to the boat 100. The support frame 211 includes one or more support struts (e.g., support struts 215 and 216) that engage and support the side shade cover 205 at one end and engage the boat 100 at the other end. For example, the support struts 215, 216 may be engaged with corners or edges of the side shade cover 205 using hooks that engage stitched and reinforced holes in the side shade cover 205, pockets or sleeves that receive the end of the support struts 215, 216, or any other suitable mechanism.

While the side shade assembly 200 is shown attached to the port side 111 of the boat 100, the side shade assembly 200 (or, depending on the configuration of the boat 100, another side shade assembly 201 that is a mirror image) also could be attached to the starboard side 112 of the boat 100. In some embodiments, the side shade assembly 200 can be configured to interchangeably attach to either side of the boat 100 or as noted above, multiple side shade assemblies 200, 201 can be used, such as one on each of the port side 111 and the starboard side 112 of the boat 100, as shown in FIGS. 1 through 4. In some embodiments, the side shade assembly 200, 201 includes side shade covers for both the port side 111 and the starboard side 112.

FIG. 5 provides a detail view of the side shade assembly 200, here attached to the port side 111 of the boat 100. However, this discussion applies equally when the side shade assembly 200 is attached to the starboard side 112 of the boat. In this example, the support frame 211 of the side shade assembly 200 is mounted to the port leg 131 of the tower 130, although the support frame 211 alternatively could be attached to other portions of the boat 100, such as the port gunwale 126 or the deck 109.

In this example, the support frame 211 has a bracket 212 that attaches directly to the port leg 131 of the tower 130. Two support struts 215, 216 extend from the bracket 212 to provide tension to the side shade cover 205, so as to extend the side shade cover 205 taut in the outboard position beyond the deck 109. In other words, the support struts 215, 216 provide tension to the side shade cover 205 when extended outboard. The mounts for the support struts 215, 216 on the bracket 212 may be pivotable and rotatable to allow the support struts 215, 216 to have adjustable positions in some embodiments. The support struts 215, 216 define the angle of the side shade cover 205 relative to the deck 109 (or alternatively, relative to the top shade cover 120). In some embodiments, the angle is adjustable, for example, by pivoting the angle of the support struts 215, 216 within the housing of the support frame 211 and/or extending or shortening the length of the support struts 215, 216. Various suitable mechanisms for changing the length of the support struts 215, 216 can be used, such as those discussed with respect to FIGS. 19A and 14C.

As discussed with reference to FIGS. 1 through 4, the side shade cover 205 has multiple corners and edges, depending on its shape. The support struts 215, 216 are anchored at one end to the support frame 211, which is attached to the port leg 131 of the tower 130, and are engaged with the corners or edges of the side shade cover 205 at their other ends to provide tension and keep the side shade cover 205 taut at the desired angle.

The front and rear views of the boat 100, shown in FIGS. 2 and 3, respectively, illustrate how the side shade cover 205 extends outboard beyond the deck 109 in a direction away from the longitudinal centerline 110 at a downwards angle relative to the deck. The angle and width of the side shade cover determines the amount of shade provided to passengers in the boat 100.

Figure 6:
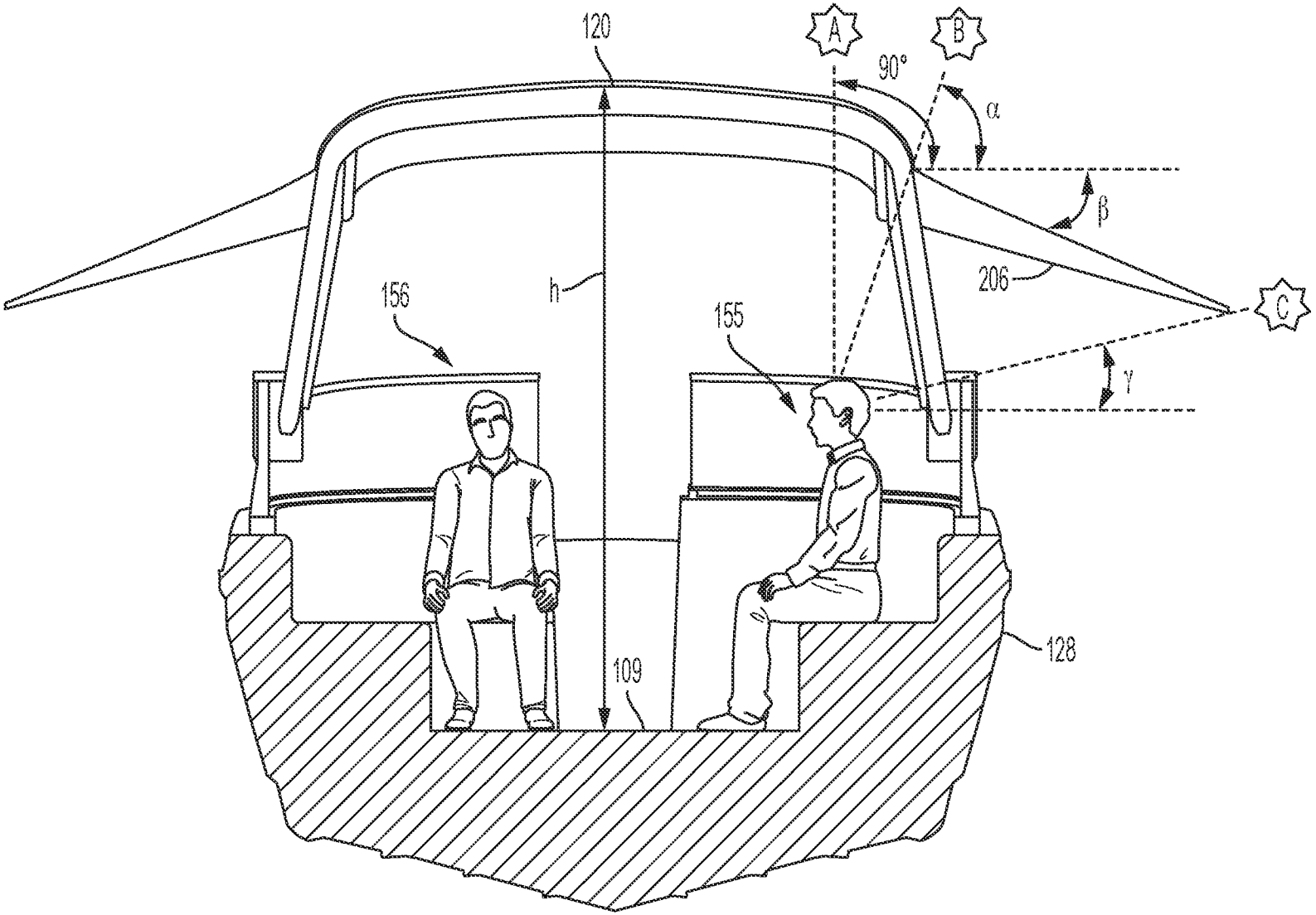
FIG. 6 is a schematic showing the coverage of the side shade cover at different angles of the sun.

FIG. 6 is a cross-sectional schematic that illustrates the geometry of the side shade cover 206 for a seated passenger 155 in the boat 100, who is seated in the primary seating area 115 near the edge of the boat 100 on the starboard side 112, with their eye level above the deck 109 and the starboard gunwale 128. The top shade cover 120, located at a height h above the deck 109, provides shade to the passenger 155 from directly above, i.e., when the sun is at position A, at an elevation angle of 90° relative to the deck 109. Since the top shade cover 120 extends out at maximum to the edge of the deck 109 and gunwale 128, the top shade cover 120 is only able to provide shade for angles of the sun in the sky from position A (90°) to position B, represented by angle α (relative to the deck 109). Angle α may range from 89° to 60° in some embodiments, though the actual maximum angle α for which the top shade cover 120 is dependent on the boat geometry and the position of the passenger 155.

For another passenger 156 seated farther inboard than passenger 155, e.g., seated in the stern seating area 117, the angle α will decrease (and be different than for passenger 155). If a passenger were seated directly on the starboard gunwale 128, then the angle α would be 90°, i.e., the top shade cover 120 could not provide shade at any position other than position A.

For positions of the sun in the sky lower than position B with an angle relative to the deck 109 that is smaller than angle α, the top shade cover 120 is unable to provide shade to the passenger 155 seated in the position shown in FIG. 6. As a result, to provide shade at these lower angles of the sun, side shade cover 206 may be deployed at an angle β relative to the deck 109. Depending on the configuration of the side shade cover 206, the angle β of the side shade cover 206 can vary from 0° to 90°.

At large angles of β (e.g., from 75° up to 90°), the side shade cover 206 also may be used as a water intrusion inhibiter. In other words, the side shade cover 206 may protect the passenger 155 from water splashing into the boat from waves, wakes, wind, rain, etc. by lowering the side shade cover 206 further. This protection against water comes at the expense of visibility towards the horizon, though in such cases where water protection is desired, shade may not be the passengers' primary concern. Therefore, the side shade cover 206 functions not just as a protection from the sun but also as a protection from the water.

Note that, in some embodiments, the side shade cover 206 may no longer extend outboard beyond the deck 109 where angle β is 90°. For example, if the support struts (e.g., support struts 315, 316, 317) are removed, then the side shade cover 206 would no longer have support to extend beyond the deck 109, and would instead hang downwards from the attachment point (e.g., fastener 345) along the outboard edge (e.g., starboard edge 144) of the top shade cover 120. The side shade cover 206 could then be secured in the vertical (β=90°) position, for example by fastening the outboard edge of the side shade cover 206 to portions of the gunwales (e.g., cleats 442, 443). In this position, however, the advantages of visibility relative to a side curtain are lost. The advantages of a side shade cover 206 (when configured such that β<90°) relative to a side curtain (β=90°) are discussed further with reference to FIG. 9.

Figure 7:
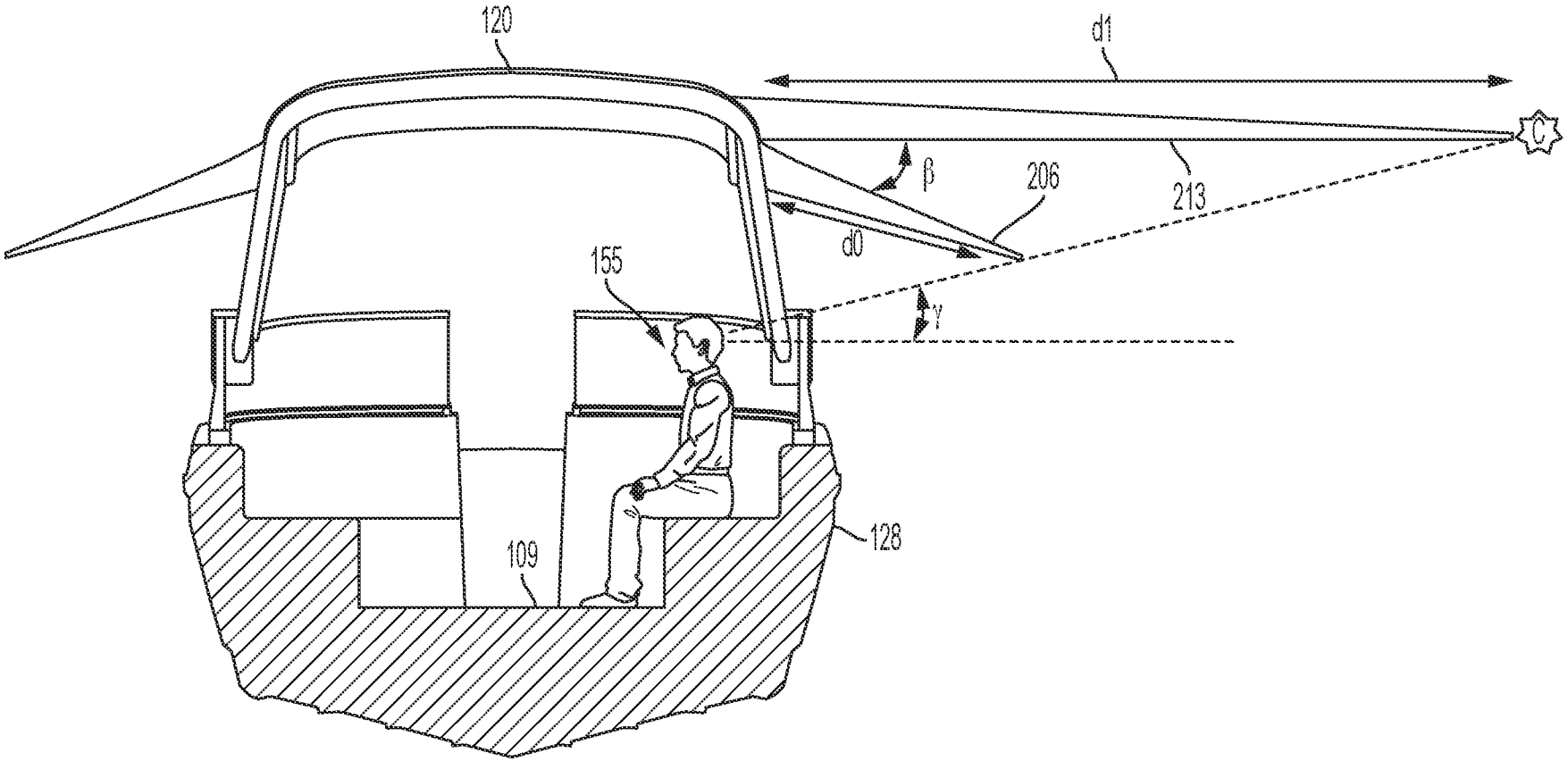
FIG. 7 is a schematic comparing the coverage of an angled side shade cover with a horizontal side shade cover.

As shown in FIG. 7, at an angle β of 0°, the side shade cover 206 extends horizontally beyond the starboard gunwale 128 and the deck 109. At non-zero values of β, the side shade cover extends at an angle, which may be upwards (for negative values of β) or downwards (for positive values of β). However, common ranges of values for β may be from 25° to 75°, or more commonly from 45° to 60°. These ranges are examples of effective ranges for providing shade at positions of the sun from position B to position C. These ranges are effective for providing shade without obstructing (or at least minimizing the obstruction of) the field of view of a passenger 155 towards the horizon or horizontally along the plane of the deck 109, as discussed further with respect to FIG. 9.

Position C, the lowest position of the sun for which the side shade cover 206 does not provide shade, is represented by angle γ, which may range in some embodiments from 15° to 45° in some embodiments, though the actual minimum angle γ is dependent on the boat geometry and the position of the passenger 155. For the other passenger 156 seated more inboard, with the side shade cover 206 in the same position, the angle γ will be lower than for passenger 155.

In the discussion above, the angles α, β, and γ are all defined relative to the deck 109. However, one or more of these angles may alternatively be defined relative to the top shade cover 120. For example, if the top shade cover 120 is curved with a different height h at different positions along the longitudinal centerline 110, then the side shade cover 206 can be configured to also vary to provide consistent shade for different positions of the sun (A, B, C)—e.g., consistent values of α, β, and γ along the centerline, or different values of α, β, and γ depending on the amount of shade desired for each of the seating areas 114, 115, 117.

As noted above, the side shade cover 206 may be in a horizontal position, corresponding to an angle β of 0°. However, as shown in FIG. 7, a horizontal side shade cover 213 typically extends farther outboard from the boat 100 to provide the same cover to occupants of the boat as a downwardly-angled side shade cover 206, and therefore would require more structural support. Consider a side shade cover 206 of length d0 extended outboard at a non-zero angle β to provide shade to passenger 155 for angles of the sun higher than a given angle γ. In order to provide the same shade coverage to passenger 155, a horizontal (i.e., β=0°) side shade cover 213 must have a longer length d1. The required length can be expressed according to the following Equation (1):

$$d1 = d0\left(\cos\beta + \frac{\sin\beta}{\tan\gamma}\right) \tag{1}$$

Figure 8:
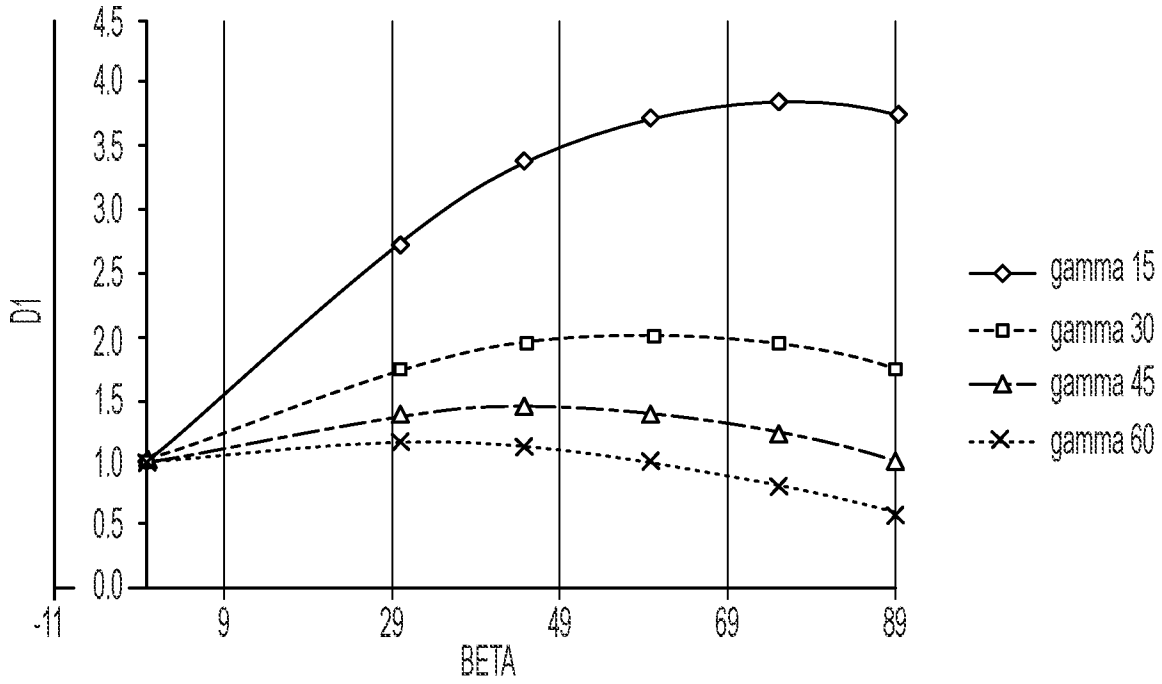
FIG. 8 is a plot of relative length of a horizontal side shade cover providing equal shade coverage to an angled side shade cover, for various angles of the sun.

FIG. 8 shows a plot of Equation (1) for different values of β and γ. For a very high angle of the sun (e.g., γ=60°), the length d1 of the horizontal side shade cover ranges from at maximum 11% longer than the length d0 of the angled side shade cover (for low values of β, e.g. β smaller than 60°), to being at minimum 60% of the length of d0 (for high values of β, e.g. β greater than 60°). For an intermediate angle of the sun (e.g., γ=45°), the length d1 of the horizontal side shade cover ranges from nearly equal to d0 to 41% longer than d0. For a low angle of the sun (e.g., γ=30°), the length d1 of the horizontal side shade cover is always longer than d0, up to twice as long. For even lower angles of the sun (e.g., γ=15°), the length d1 of the horizontal side shade cover is almost four times longer. The advantage of having a shorter length side shade cover (d0<d1) is that the support frame 211 requires fewer and/or shorter support struts 215, 216 to support a side shade cover 205 when it is angled (β>0) than when it is horizontal (β=0).

Further examples for various values of β and γ of d1 relative to d0 calculated from Equation (1) are provided in Table 1. The value of d0 is assumed to be a unit length, so the value of d1 shown is the ratio of d1 to d0. In some embodiments, the side shade cover 205 may be configured at different angles β as needed, by adjusting the position of one or more support struts 215, 216, in order to provide shade coverage at different times of day (i.e., different values of γ). The length of the side shade cover accordingly may be adjusted depending on the configured angle β, for example by rolling up the side shade cover 205 if made of canvas, as well as other suitable contemplated mechanisms.

TABLE 1

| γ | β | d1/d0 |
|---|---|---|
| 15 | 75 | 3.9 |
| 15 | 60 | 3.7 |
| 15 | 45 | 3.3 |
| 15 | 30 | 2.7 |
| 30 | 75 | 1.9 |
| 30 | 60 | 2.0 |
| 30 | 45 | 1.9 |
| 30 | 30 | 1.7 |
| 45 | 75 | 1.2 |
| 45 | 60 | 1.4 |
| 45 | 45 | 1.4 |
| 45 | 30 | 1.4 |
| 60 | 75 | 0.8 |
| 60 | 60 | 1.0 |
| 60 | 45 | 1.1 |
| 60 | 30 | 1.2 |

Figure 9:
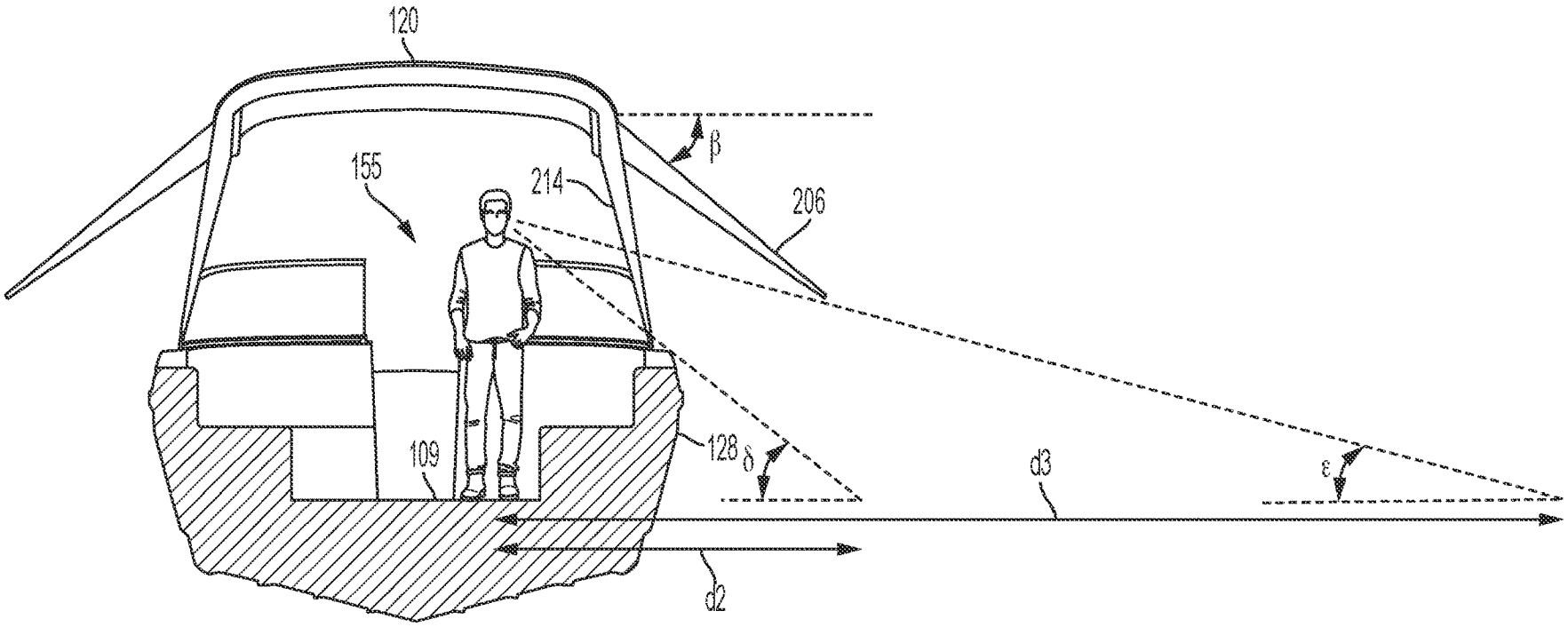
FIG. 9 is a schematic comparing the visibility from a side shade cover to that of a side curtain.

The side shade cover extends outboard beyond the deck and the hull, with an angle β<90° relative to the deck 109 (or, in some embodiments, relative to the top shade cover 120). In contrast, a side curtain hangs directly downwards, at an angle β=90° (i.e., perpendicular to the deck 109 and/or the top shade cover 120). FIG. 9 illustrates a comparison between a side shade cover 206 at an angle β relative to the deck 109 and a side curtain 214. In this example, both the side shade cover 206 and the side curtain 214 are the same length d0, and both attach to the starboard edge 144 of the top shade cover 120.

Due to the obstruction by the side curtain 214, the line of sight for a passenger 155 makes an angle of δ relative to the deck 109 as the passenger 155 looks outside the boat 100. In this example, the passenger 155 is standing, but alternatively could be seated, and the same discussion still would apply. The distance d2 to where the passenger's 155 line of sight intersects the horizontal plane of the deck 109 is therefore defined by Equation (2):

$$d2 = \frac{h2}{\tan(\delta)} \tag{2}$$

In Equation (2), h2 is the eye level of the passenger 155 above the deck 109. If the side shade cover 206 is installed instead of the side curtain 214, the line of sight makes an angle ε relative to the deck 109. The distance d3 to where the passenger's 155 line of sight intersects the horizontal plane of the deck is then defined by Equation (3):

$$d3 = \frac{h2}{\tan(\varepsilon)} \tag{3}$$

Since the side curtain 214 and the side shade cover 206 have the same length d0, and since the angle b of the side shade cover 206 is less than the angle (90°) of the side curtain, it can be shown that the angle δ is greater than the angle ε. Accordingly, tan(δ) is greater than tan(ε), but due to the inverse in Equation (2) and Equation (3), this makes the value of d3 greater than d2.

In other words, by angling the side shade cover 206 so that it extends outboard beyond the boat 100, the view of the passenger 155 is substantially less obstructed. Higher angles β of the side shade cover 206 provide geometrically greater distance of view beyond the boat, compared to a side curtain 214.

In order to provide effective shade coverage for a wide range of angles of the sun (e.g., γ=15° to 60°), the range for β preferably is from 30° to 75°. At low angles of the sun (γ=15° to 45°), the range for β preferably is from 45° to 75°. At high angles of the sun (γ=45° to 60°), the range for β preferably is from 30° to 45°. These values of β for the side shade cover provide a balance between effective shade coverage without unwieldy length and preservation of field of view. In other words, these preferred ranges of β for the side shade cover are high enough to provide equivalent coverage as a horizontal side shade cover, but with shorter length, requiring less structural support since the angled side shade cover does not extend as far outboard. These preferred ranges are also low enough to also provide substantially increased field of view towards the horizon compared to a side curtain of equal length.

Figure 10:
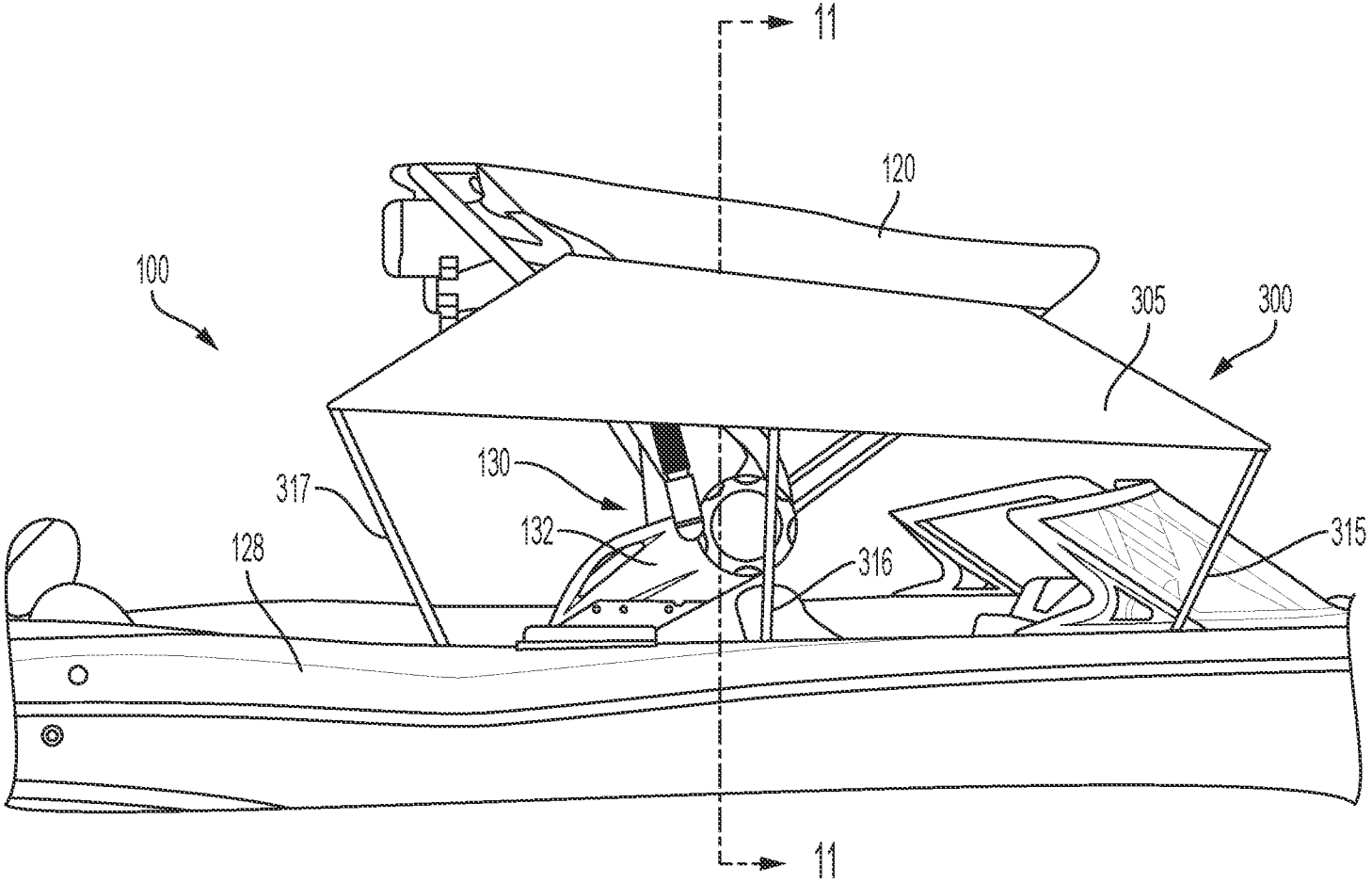
FIG. 10 shows another embodiment of a side shade assembly.

The side shade assembly 200 shown in FIG. 5 uses two support struts 215, 216. In other embodiments, the support frame 211 may use a different number of support struts, such as a single support strut, three support struts, or more than three support struts. For example, FIG. 10 shows an embodiment of a side shade assembly 300 that includes a side shade cover 305 supported by three support struts 315, 316, 317. Though shown in FIG. 10 mounted to the starboard side 112 of the boat 100, the side shade assembly 300 could be mounted on the port side 111, or an assembly could be mounted on each side. The side shade assembly 300 shown in FIG. 10 is similar to the embodiment of the side shade assembly 200 discussed above with respect to FIGS. 1 through 5, and like reference numerals have been used to refer to the same or similar components. A detailed description of these components will be omitted, and the following discussion focuses on the differences between these embodiments. Any of the various features discussed with any one of the embodiments discussed herein may also apply to and be used with any other embodiments.

Though similar to the support struts 215, 216 described with reference to FIG. 5, the support struts 315, 316, 317 attach directly to the starboard gunwale 128 in this embodiment. In other embodiments, the support struts 315, 316, 317 may attach to other suitable locations on the boat 100, such as the port leg 131 or the starboard leg 132 of the tower 130, or to the deck 109.

Figure 11:
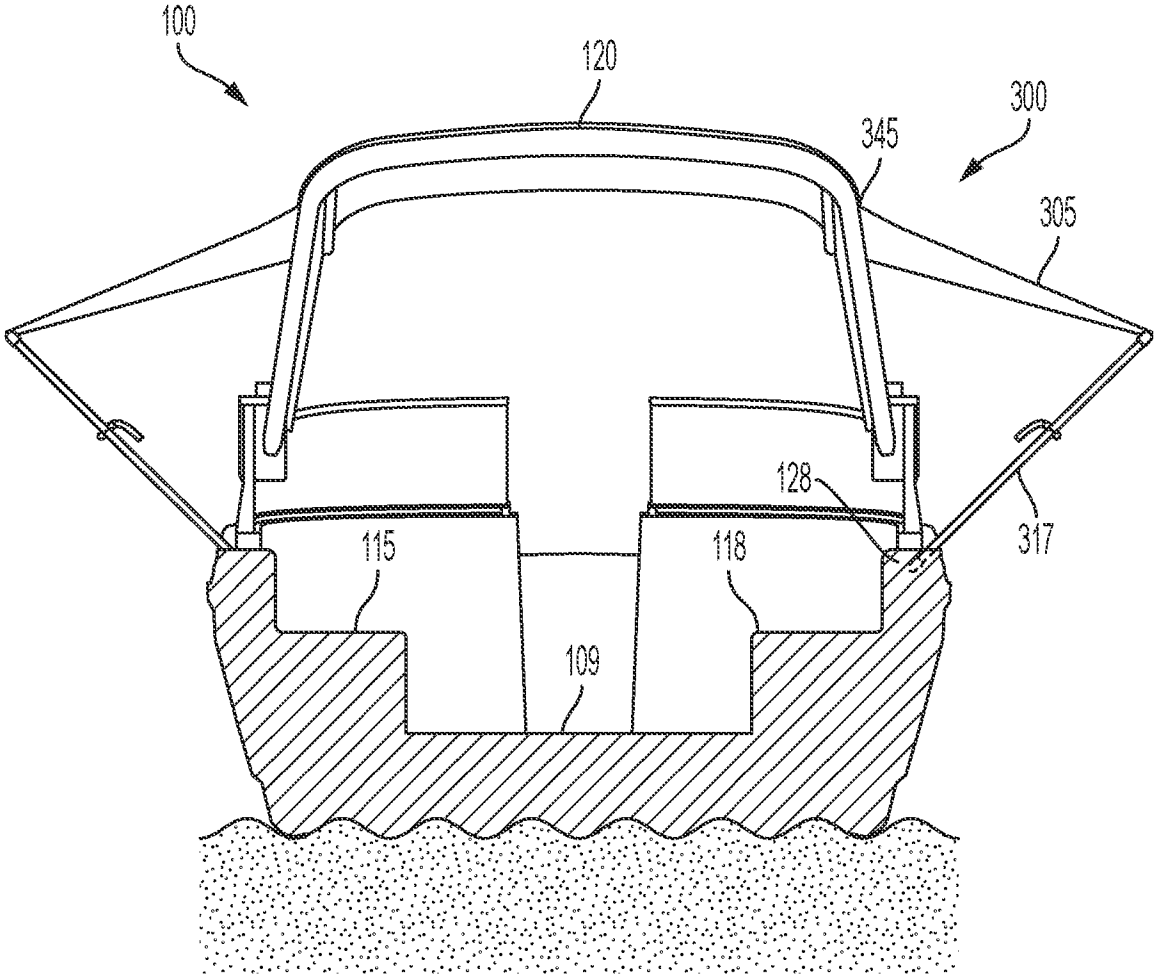
FIG. 11 shows a cross-section of the boat and the side shade assembly taken along section line 11-11 in FIG. 10.
Figure 12:
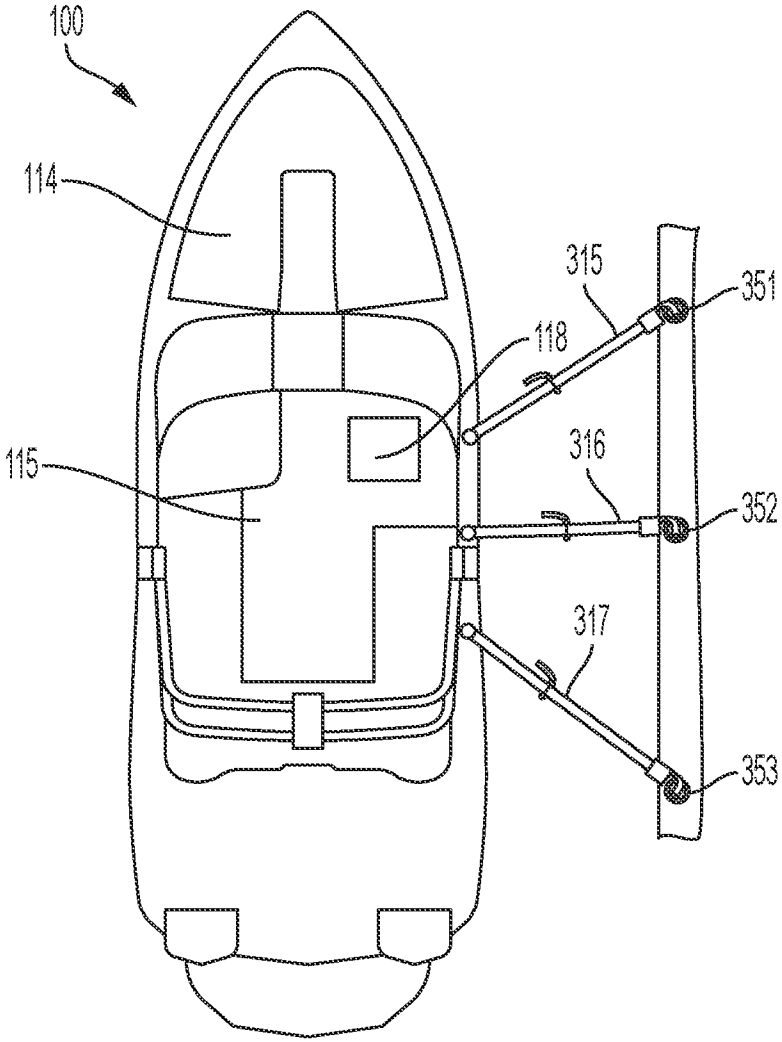
FIG. 12 shows an overhead view of the boat and the side shade assembly shown in FIG. 10, with the cover of the side shade assembly and the top shade cover omitted for clarity.

FIG. 11 shows a cross-section aft view of the boat 100 and the side shade assembly 300 taken along section line 11-11 in FIG. 10. FIG. 12 shows an overhead view of the boat 100 and the side shade assembly 300 from FIG. 10, with the side shade cover 305 and the top shade cover 120 omitted for clarity. In FIGS. 11 and 12, the side shade assembly 300 is shown mounted to the starboard side 112 of the boat 100, though the side shade assembly 300 could be mounted on the port side 111, or an assembly could be mounted on each side. As shown, the top shade cover 120 provides shade coverage for at least one of the seating areas 114, 115, 117 (including the control console 118) receive shade by when the sun is directly overhead, and the side shade cover 305 provide shade coverage when the sun is at an angle from the starboard side 112.

Some embodiments of the side shade assembly 200, 300, 400 discussed herein may be removable and modular. For example, the side shade assembly 300 may be disassembled into its component parts (e.g., the side shade cover 305 and the support struts 315, 316, 317) for easy storage and stowing when not in use. As shown in the example of FIGS. 11 and 12, the side shade cover 305 is attached with a fastener 345, such as a zipper, to the top shade cover 120, more specifically to the starboard edge 144 of the top shade cover 120. The side shade cover 305 can be easily attached and removed as desired using the fastener 345. Preferably, the fastener 345, such as a zipper, creates a watertight seal between the side shade cover 305 and the top shade cover 120.

The support struts 315, 316, 317 may be removably attached to the boat 100 and the side shade cover 305. For example, each of the support struts 315, 316, 317 may have a hook at one end, which engages with a respective loop, grommet, or ring 351, 352, 353 in the side shade cover 305. The ring 351, 352, 353 may be metal or plastic, or may be a loop of the same material as the side shade cover 305. The support struts 315, 316, 317 also may be removably attached at the other end to the deck 109 or the starboard gunwale 128. For example, the starboard gunwale 128 may have hollow receivers, into which the support struts 315, 316, 317 are inserted. The support struts 315, 316, 317 may be further secured in the receiver by a pin, a strap, a locking button, threads, or other locking and securing mechanisms.

Figure 13:
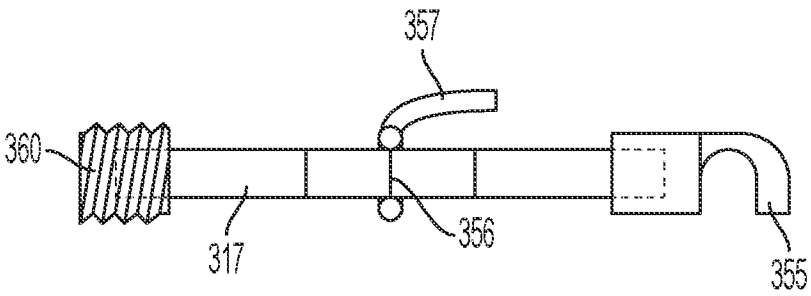
FIG. 13 is a detail view of a strut for the side shade assembly shown in FIG. 10.

FIG. 13 shows a detail view of support strut 317, which has a hook 355 at one end to engage with a ring 353 on the side shade cover 305. The support strut 317 also has a joint 356, which allows the support strut 317 to bend by folding, and a latch 357 to allow the joint 356 to lock in a fully-extended position. Alternatively, two or more portions of the support strut 317 may be pivotably connected to each other with a joint, such that the support strut 317 is fully extended when the portions are pivoted to extend in opposite directions.

In this example, the other end of the support strut 317 opposite from the hook 355 has threads 360 which allow the support strut 317 to be screwed into a receiver 362 on the starboard gunwale 128. Other methods of attaching the support strut 317 can be used, including having a hook (not shown) at the other end that engages with a loop, bracket, or hole on the starboard gunwale 128, the starboard leg 132, or the deck 109. The other support struts 315, 316 in this example may be identical to and interchangeable with support strut 317.

Figure 14C:
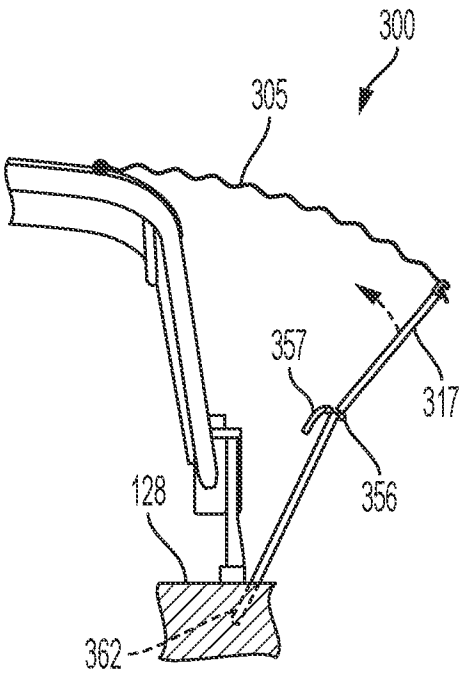
FIGS. 14A through 14C illustrate an installation process for the side shade assembly shown in FIG. 10.
Figure 14B:
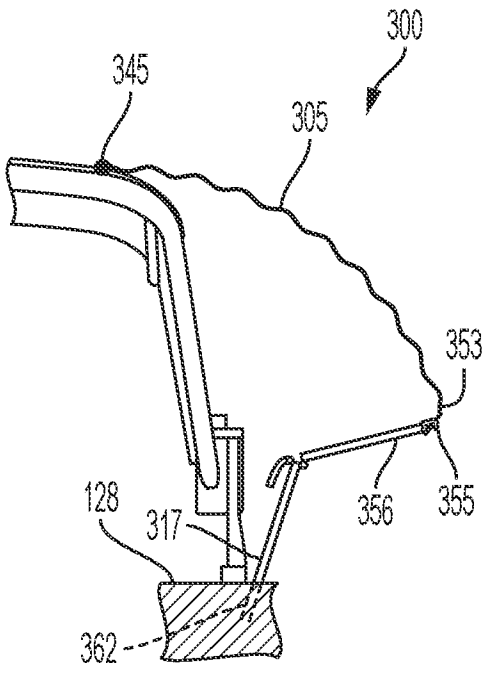
Figure 14A:
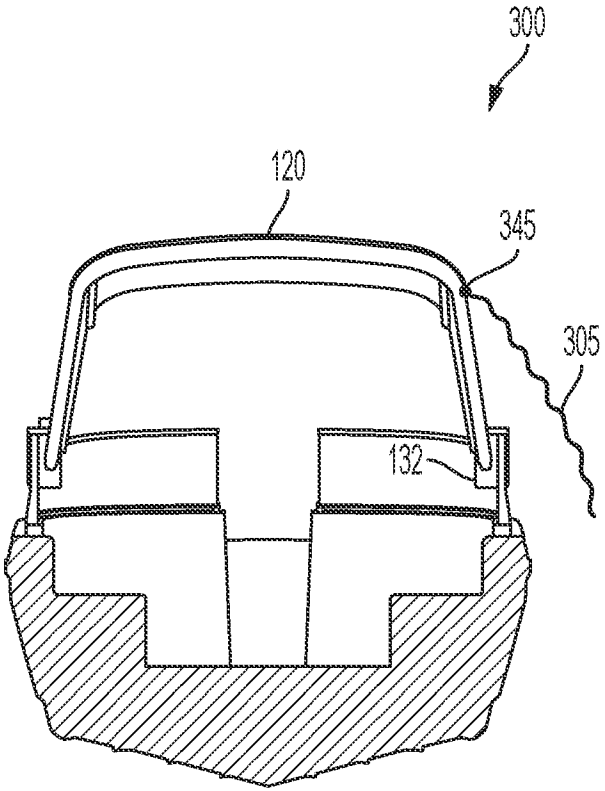

FIGS. 14A through 14C illustrate an example of an installation process for the side shade assembly 300 described in FIGS. 10 through 12. Similar steps may apply to other embodiments, such as the side shade assembly 200 or the side shade assembly 400. The steps may be performed in a different order than the order in which they are described below.

FIG. 14A shows a first step in installing the side shade assembly 300, which is to attach the side shade cover 305 to the top shade cover 120 using the fastener 345. The side shade cover 305 will then hang down the side of the starboard leg 132, since there is nothing at this stage of installation to provide support in the outboard position.

FIG. 14B shows a second step in installing the side shade assembly 300, which is to engage the hook 355 of the support strut 317 with a ring 353 of the side shade cover 305. In addition, the receiver end of the support strut 317 is inserted into a threaded receiver 362 on the starboard gunwale 128 and secured, by screwing the support strut 317 into the receiver 362 such that the threads 360 are engaged. Note that engaging the hook 355 and inserting the support strut 317 into the receiver 362 may be done in reverse order. Further, the support strut 317 is still in its bent configuration since the latch 357 has not yet been engaged to securely lock the joint 356.

FIG. 14C shows a third step in installing the side shade assembly 300, which is to press the support strut 317 in the middle, pivoting and straightening the support strut 317 until the latch 357 is engaged and the joint 356 is securely locked. This puts tension in the side shade cover 305 and keeps the side shade cover 305 extended outboard away from the boat 100. The angle of the receiver 362 and the length of the support strut 317 may be varied or configured to adjust the angle at which the side shade cover 305 extends outboard. For example, the support strut 317 may be a type of extendable-length strut, such as a telescoping strut, a sliding strut, or a segmented strut with at least one optional segment that can be sequentially attached to other segments by button locks, twist locks, tension locks, or threaded sockets. Other mechanisms for changing the length of the support strut 317 or the angle of the receiver are also contemplated. To remove the side shade assembly 300, the steps described in FIGS. 14A through 14C may be performed in the opposite order.

Figure 15:
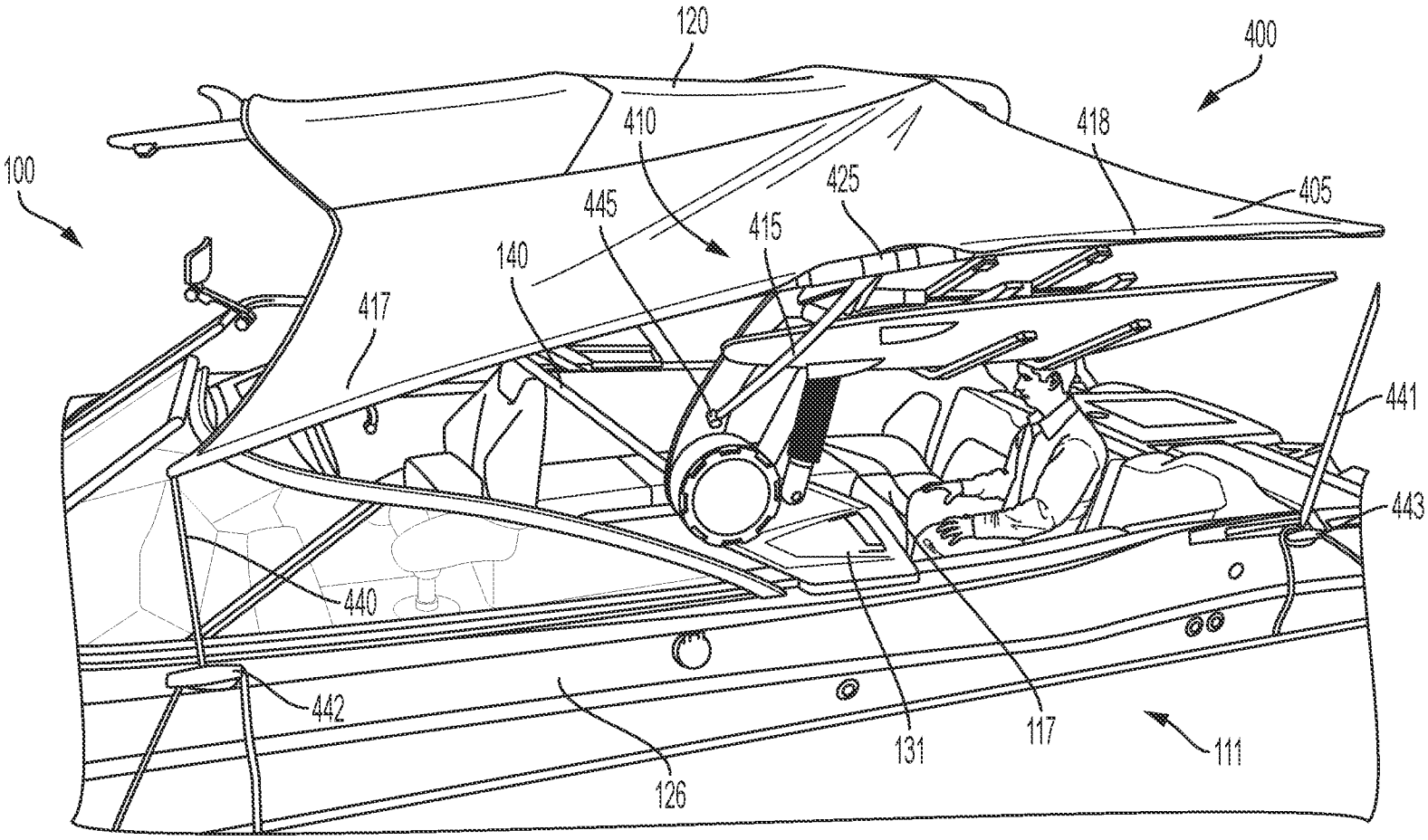
FIG. 15 shows a further embodiment of a side shade assembly.

FIG. 15 shows another embodiment of a side shade assembly 400, mounted in this example on the port side 111 of the boat 100. While similar to the embodiments of the side shade assemblies 200, 300 discussed with respect to FIGS. 1 through 12, a detailed description of these components will be omitted, and the following discussion focuses on the differences between these embodiments. Any of the various features discussed with any one of the embodiments discussed herein may also apply to and be used with any other embodiments.

Here, the side shade assembly 400 includes a port side shade cover 405 that is supported in the outboard position by a port support frame 410. The side shade assembly 400 also may include a starboard support frame and starboard side shade cover (not shown). As shown in FIG. 18C, the port support frame 410 of this embodiment includes a center support strut 415 as well as lateral support struts 417, 418 to provide additional support to the port side shade cover 405 in the forward and aft directions.

The lateral support struts 417, 418 attach to the port center support strut 415 at a port central assembly 425, forming a T-shape, where the base of the T-shape (the port center support strut 415) attaches to the boat 100 and the arms of the T-shape (the lateral support struts 417, 418) extend forward and aft. Alternatively, the side shade assembly 400 may have only a single lateral support strut, or more than two lateral support struts. In addition, the side shade assembly 400 includes support straps 440, 441, each of which attaches at one end to one of the lateral support struts 417, 418 and attaches at the other end to the boat 100, for example to cleats 442, 443 on the port gunwale 126. The support straps 440, 441 may attach to the cleats 442, 443 by being tied, hooked into a loop, or any other suitable securing means.

The port center support strut 415 removably attaches to the port leg 131 on the tower 130 in this example by a hook (e.g., hooks 416*a*, 416*b* shown in FIG. 19), which engages with a support ring 445 that is attached to the port leg 131, though any suitable method or fastener for attachment or removable attachment is contemplated, including a bracket or a socket.

Figure 16:
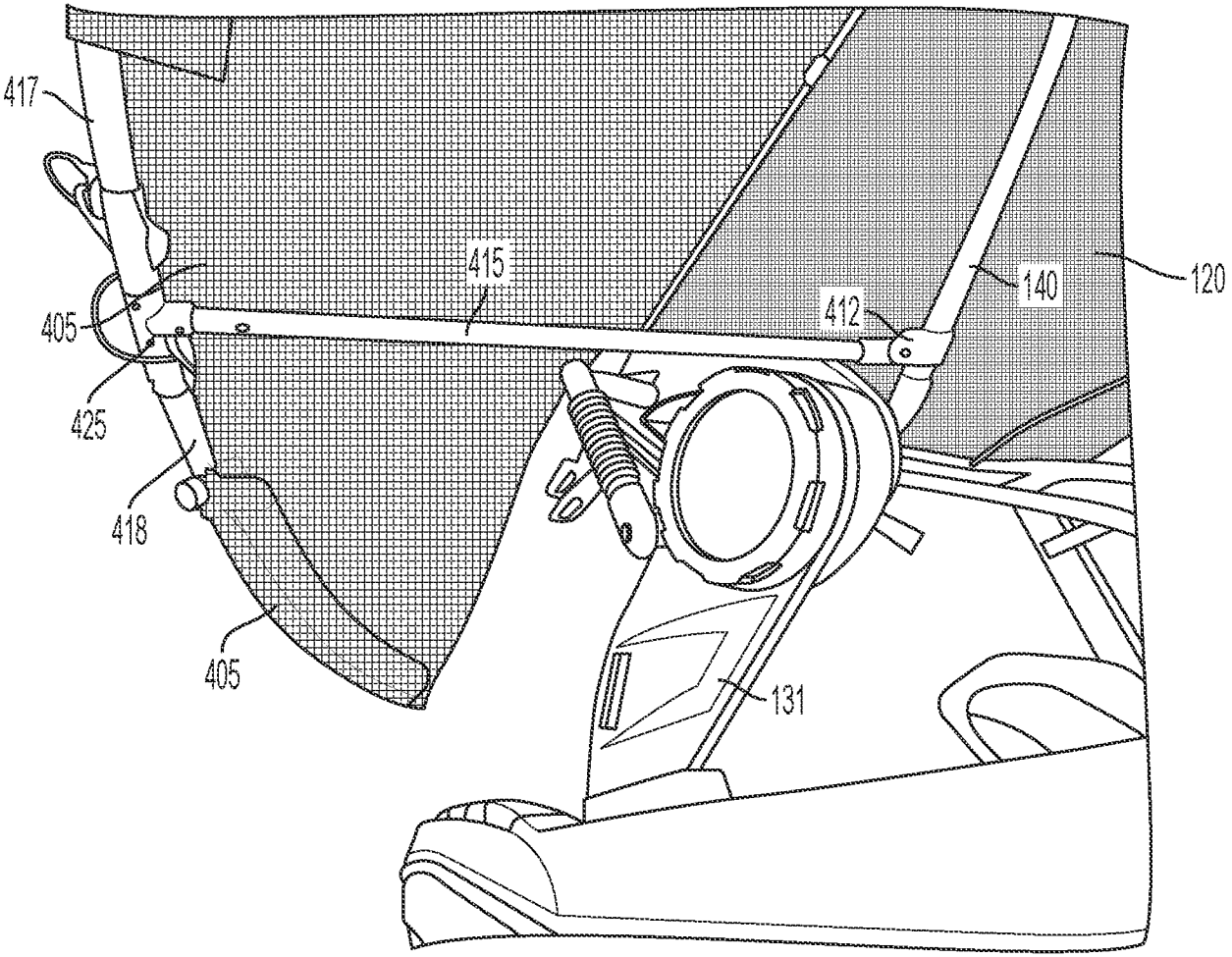
FIG. 16 shows an alternate mounting location for a center support strut of the side shade assembly shown in FIG. 15.

FIG. 16 shows an alternate mounting location for the port center support strut 415, in which the port center support strut 415 mounts directly to the bimini frame 140, instead of to the port leg 131 of the tower 130. The port center support strut 415, the port central assembly 425, and the lateral support struts 417, 418 are visible in FIG. 16, and the port side shade cover 405 is translucent with a different opacity than the top shade cover 120. In other embodiments, the port side shade cover 405 and the top shade cover 120 have the same opacity.

Figure 17:
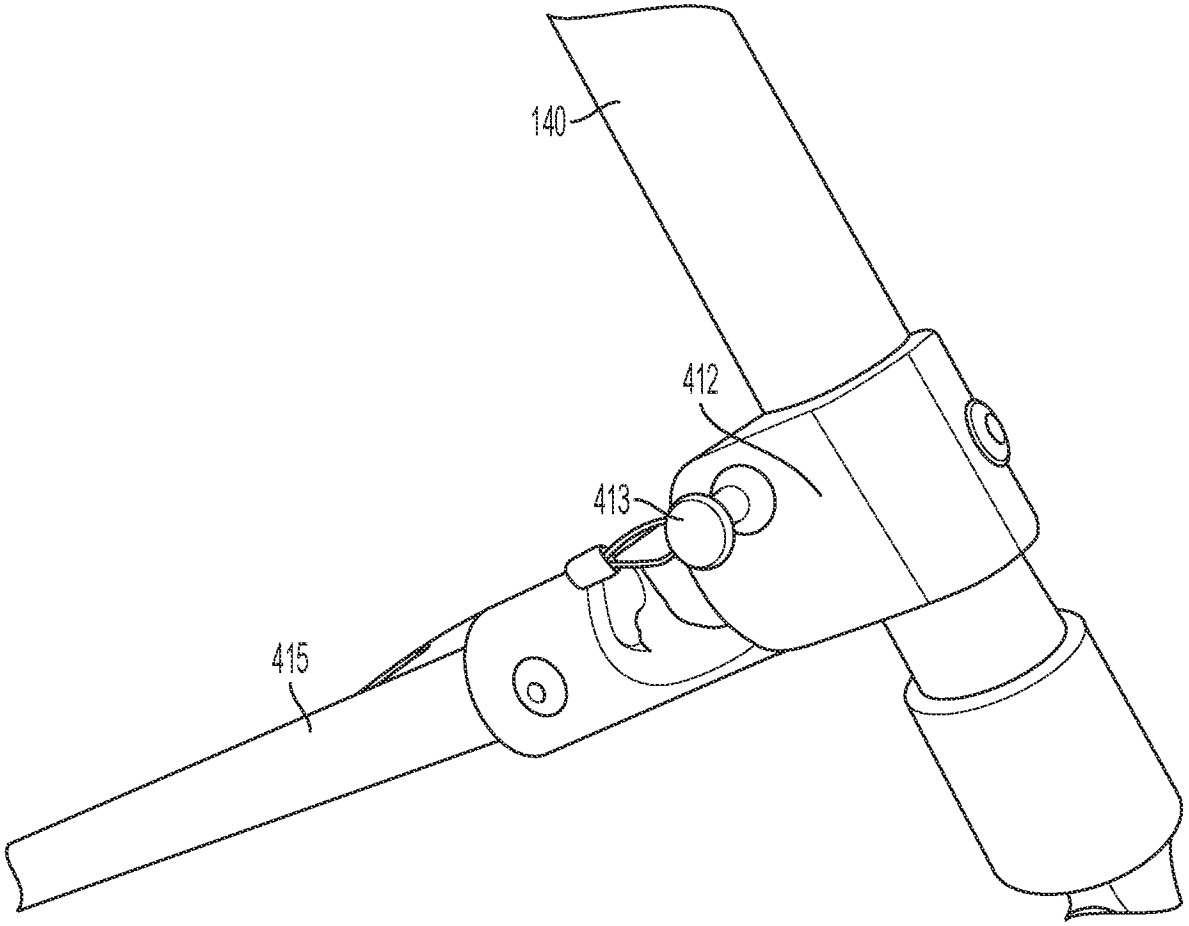
FIG. 17 is a detail view of the mounting location in FIG. 16.

In the example of FIG. 16, the port center support strut 415 is supported by a bracket 412 that attaches directly to the bimini frame 140, instead of the port leg 131. A detail view of the bracket 412 is shown in FIG. 17, which illustrates a quick-release mechanism 413 to enable the side shade assembly 400 to be quickly disengaged from the boat 100.

Figure 18D:
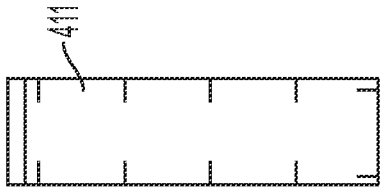
FIG. 18D shows a storage bag for the components of the side shade assembly shown in FIGS. 18A through 18C.
Figure 18C:
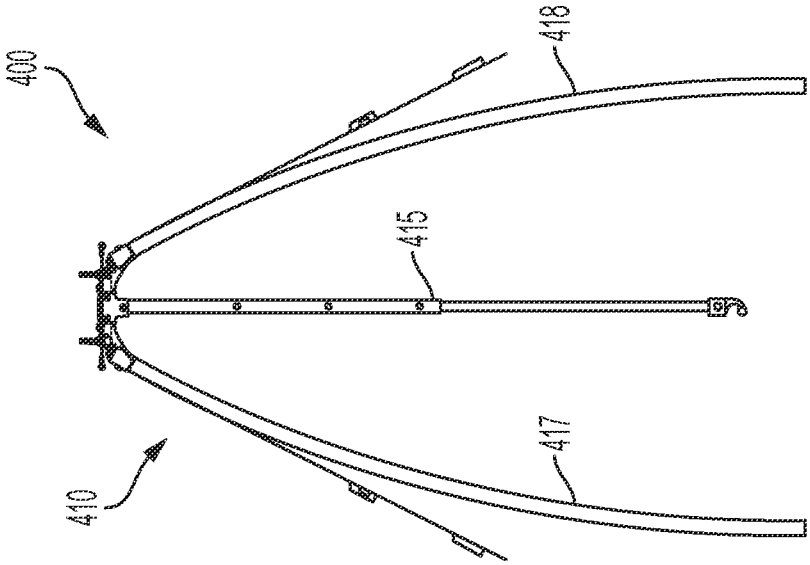
FIG. 18C shows a port support frame for the side shade assembly shown in FIG. 15.
Figure 18A:
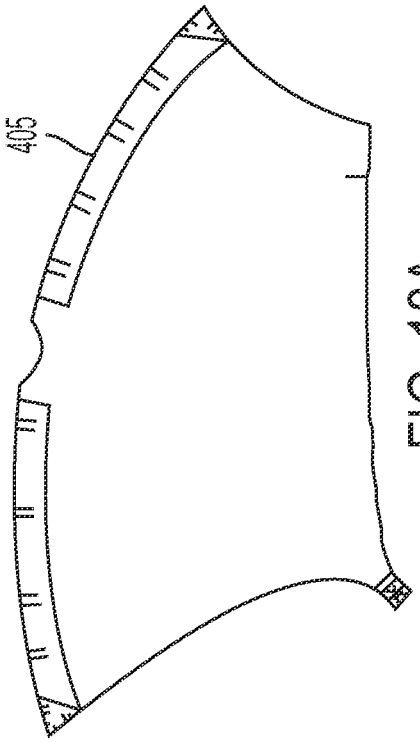
FIG. 18A shows a port side shade cover for the side shade assembly shown in FIG. 15.
Figure 18B:
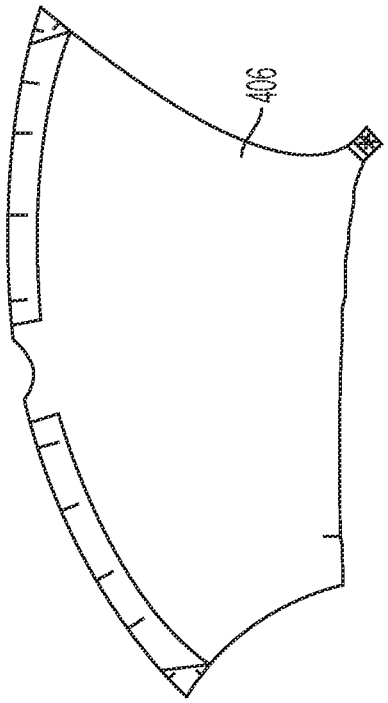
FIG. 18B shows a starboard side shade cover for the side shade assembly shown in FIG. 15.

FIGS. 18A through 18D show detail views of certain components of the side shade assembly 400. FIG. 18A shows the port side shade cover 405, FIG. 18B shows the starboard side shade cover 406, FIG. 18C shows the port support frame 410, and FIG. 18D shows a storage and transport bag 411. Although not shown, the starboard support frame is identical. The port side shade cover 405 is not identical to the starboard side shade cover 406 since they are mirror images of each other. In order to assist in assembling the side shade assembly 400, in this example the starboard side shade cover 406 has single notches in the fabric, and the port shade cover 405 has double notches. Other ways to distinguish the port and starboard side shade covers 405, 406 can be employed, such as including stitching or printing the words "port" and "starboard" onto the covers or onto labels attached to the covers.

Figure 19A:
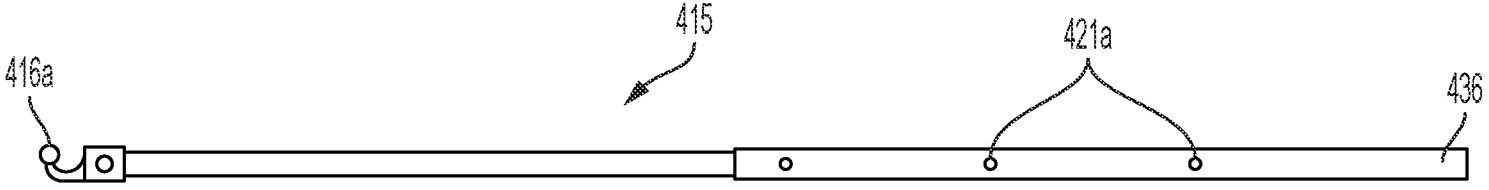
FIG. 19A shows a detail view of the port center support strut for the port support frame shown in FIG. 18C.
Figure 19B:
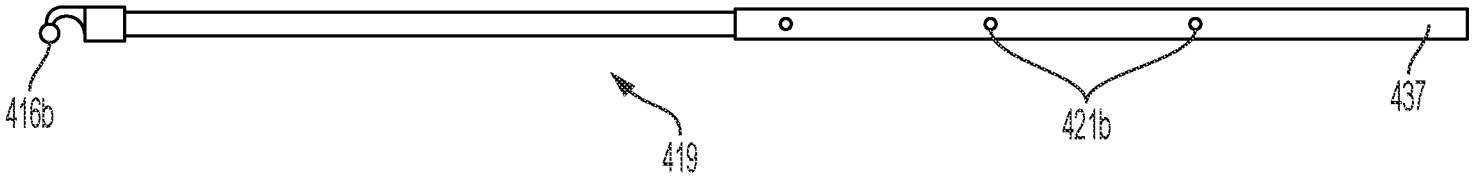
FIG. 19B shows a detail view of a starboard center support strut for a starboard support frame similar to the port support frame shown in FIG. 18C.

FIG. 19A shows a port center support strut 415 for the port support frame 410. FIG. 19B shows a corresponding starboard center support strut 419 for the starboard support frame (not shown). The port and starboard center support struts 415, 419 each have hooks 416*a*, 416*b* at one end, for attaching to a deck 109, port gunwale 126, starboard gunwale 128, bimini frame 140, or tower 130 of a boat 100. In addition, the port and starboard center support struts 415, 419 have a number of button locks 421*a*, 421*b*, which allow the length of the port and starboard center support struts 415, 419 to be adjusted. These adjustments permit the port and starboard side shade covers 405, 406 to be attached at a desired angles outboard. Note that the port and starboard center support struts 415, 419 may be independently adjusted to different lengths if desired, so that the port side shade cover 405 can be positioned at a different angle of extension outboard beyond the deck than the starboard side shade cover 406. Examples of mechanisms for adjusting the length of the port and starboard center support struts 415, 419 are discussed with respect to the side shade assembly 300 in FIG. 14C.

Figure 20:
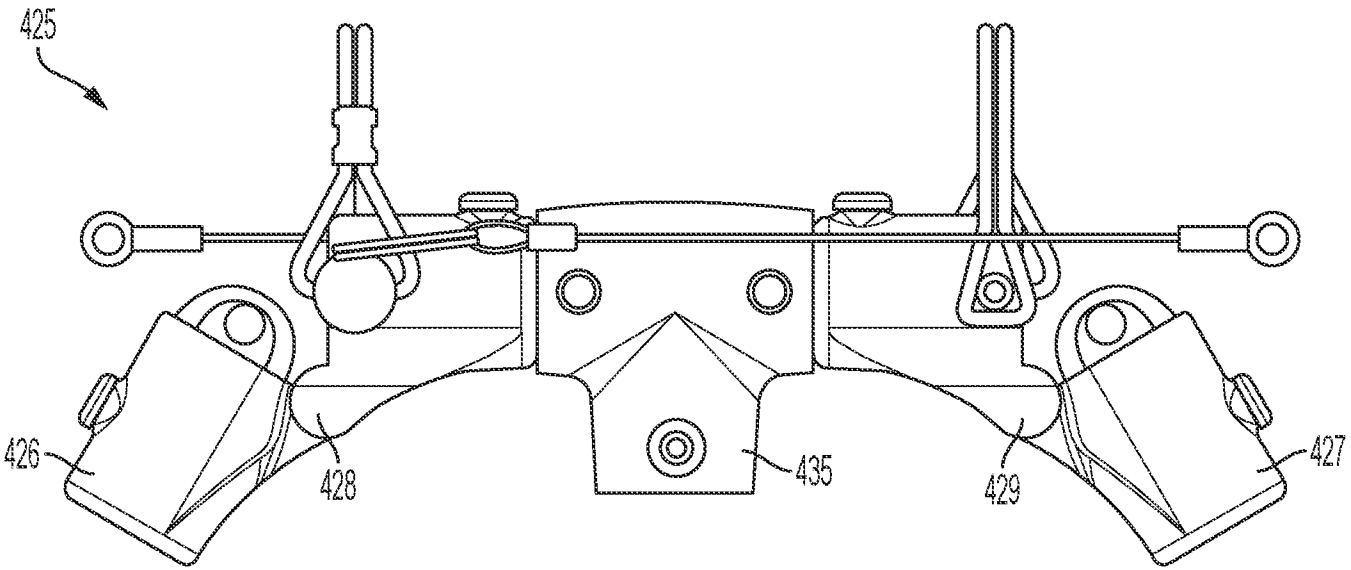
FIG. 20 shows a detail view of the port central assembly for the port support frame shown in FIG. 18C.

FIG. 20 shows an example of a port central assembly 425 for the port support frame 410. The starboard central assembly for the starboard support frame is not shown, but in this example would be identical. The port central assembly 425 has aft and forward receivers 426, 427, each of which receives a lateral support strut 417, which is described in more detail with reference to FIG. 21. The aft and forward receivers 426, 427 include latching joints 428, 429 that allow a lateral support strut 417 to be installed in an open position, and then locked into place to provide tension in the aft and forward directions to the port side shade cover 405 when fully extended outboard.

The receivers 426, 427 pivot about the latching joints 428, 429, and are secured using additional fasteners, locking pins, and/or cables, which may also be used to fully secure lateral support struts to the port central assembly 425 and to the port side shade cover 405 when inserted and in the locked position. In some embodiments, the receivers may be secured at an adjustable intermediate angle, to modify the position and angle of the port side shade cover 405 to provide cover to the seating areas 114, 115, 117 at different times of day, as discussed with reference to FIGS. 6 through 9.

The port central assembly 425 for the port support frame 410 has a central receiver 435, which receives an end 436 of the port center support strut 415. The starboard center support strut 419 has an end 437, which is received by an identical central receiver of the starboard frame assembly's center assembly (not shown). The port center support strut 415 is secured to the central receiver 435 using rivets, though screws and other suitable mechanisms also can be used.

Figure 21:
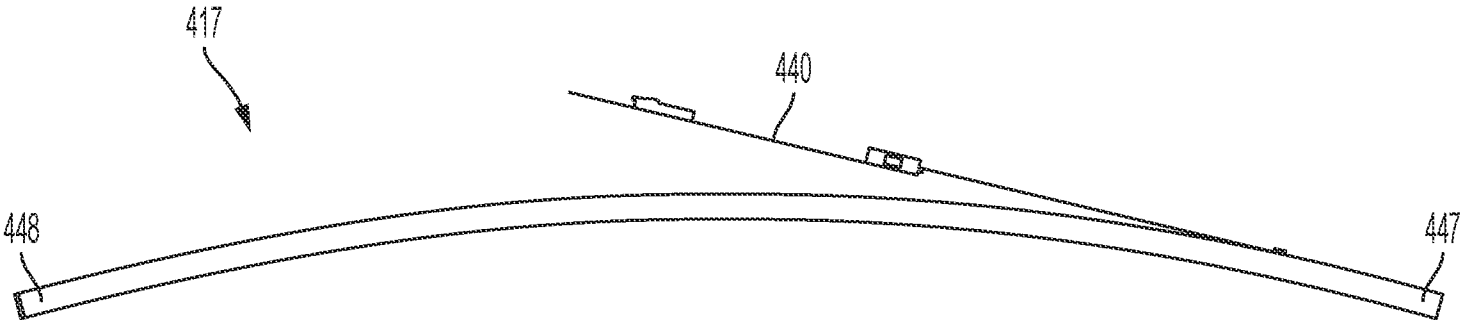
FIG. 21 shows a detail view of a lateral support strut for the port support frame shown in FIG. 18C.

FIG. 21 shows a detail view of the lateral support strut 417 for the port support frame 410. The port frame assembly may utilize two such struts, one aft and one forward, though only one such strut is shown in FIG. 21. Likewise, the starboard frame assembly (not shown) may utilize an additional two such struts. In this example, the aft and forward struts are identical, whereas in other embodiments they may be different, e.g., mirror images, depending on the shape of the port and starboard side shade covers 405, 406 and the dimensions and configuration of the boat 100, including other attachments to the tower 130 such as board racks, tow lines, and other accessories. The lateral support strut 417 also may include a support strap 440, which is attached securely (e.g., with a rivet, a locking pin or button, or other suitable fastener) to the lateral support strut 417. The support strap 440 may be attached to the lateral support strut 417 at any point along the length of the lateral support strut 417, including the opposite end 448 of the lateral support strut 417. The other end of the support strap 440 may secure the lateral support strut 417 to the boat 100 (e.g., to a cleat, a gunwale, the deck, etc.), as shown in FIG. 15. In this example, the lateral support strut 417 is inserted at end 447 to either one of the aft and forward receivers 426, 427. If used for the port support frame 410, the length of the lateral support strut 417 may be inserted into a sleeve along the outer edge of the port side shade cover 405 to fully engage and support the port side shade cover 405. Likewise, if used for the starboard support frame, the lateral support strut 417 may be inserted into a similar sleeve of the starboard side shade cover 406 to fully engage and provide support.

As described above, a side shade cover frame assembly can be modular, composed of multiple components. In other embodiments, the frame assembly is a single, integral assembly, which can include lateral support struts, or alternatively not include lateral support struts. Additional mechanisms for securing lateral support struts to the assembly (whether modular or integral) are contemplated, including threaded ends, screws, latches, and button locks.

Although this invention has been described with respect to certain specific exemplary embodiments, many additional modifications and variations will be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

What is claimed is:

1. A boat comprising:

a bow and a stern;

a deck between the bow and the stern;

a longitudinal centerline extending from the bow to the stern dividing the deck into a port side and a starboard side;

a hull that surrounds the deck, the hull including a port gunwale and a starboard gunwale;

a top shade cover disposed directly above at least a portion of the deck and supported by a port side vertical support attached to the port gunwale and a starboard side vertical support is attached to the starboard gunwale; and a side shade assembly attached to the boat on one of the port side of the deck or the starboard side of the deck, the side shade assembly including a frame and a side shade cover supported by the frame such that the side shade cover extends outboard beyond the deck in a direction away from the longitudinal centerline, wherein the frame includes a strut having a first end and a second end, the first end of the strut being configured to attach to the side shade cover, the second end of the strut being configured to attach to one of the deck, the hull, the port gunwale, the starboard gunwale, the port side vertical support, or the starboard side vertical support, wherein the strut provides tension to the side shade cover while the side shade cover extends outboard, and wherein the strut is removably attached to at least one of (i) the side shade cover by the first end of the strut being removably attached to the side shade cover or (ii) the boat by the second end of the strut being removably attached to the one of the deck, the hull, the port gunwale, the starboard gunwale, the port side vertical support, or the starboard side vertical support.

2. The boat of claim 1, wherein the side shade cover is configurable to extend beyond the deck at a downward angle relative to the deck, the downward angle relative to the deck being from 25° to 75°.

3. The boat of claim 1, wherein the side shade assembly is a first side shade assembly, the boat further comprising a second side shade assembly attached to the boat on an opposite side of the deck from the first side shade assembly, the second side shade assembly including another frame and another side shade cover supported by the other frame to extend outboard beyond the deck in another direction away from the longitudinal centerline.

4. The boat of claim 1, wherein the top shade cover is one of a canvas bimini or a hard top.

5. The boat of claim 1, wherein the side shade cover is attached to the top shade cover.

6. The boat of claim 5, wherein the side shade cover includes an inboard edge and an outboard edge, and wherein the side shade cover is removably attached to the top shade cover by a fastener that couples the inboard edge of the side shade cover to the outboard edge of the top shade cover.

7. The boat of claim 1, further comprising a tower that supports the top shade cover, the tower including the port side vertical support and the starboard side vertical support.

8. The boat of claim 7, wherein the frame is attached to one of the deck, the hull, the port gunwale, the starboard gunwale, the port side vertical support, or the starboard side vertical support.

9. The boat of claim 7, further comprising at least one cleat mounted to one of the deck, the hull, the port gunwale, the starboard gunwale, or the tower, wherein the side shade assembly includes at least one strap having a first end and a second end, the first end of the strap being attached to one of the side shade cover or the frame, the second end of the strap being attached to the cleat, and the strap being configurable to secure the side shade cover at a fixed position relative to the deck.

10. The boat of claim 1, wherein the strut further has a hook at the first end and the side shade cover includes a hole, the strut being removably attached to the side shade cover by the hook engaging with the hole.

11. The boat of claim 1, wherein the strut further has a hook at the second end and the one of the deck, the hull, the port gunwale, the starboard gunwale, the port side vertical support, or the starboard side vertical support includes a loop, the strut being attached to the one of the deck, the hull, the port gunwale, the starboard gunwale, the port side vertical support, or the starboard side vertical support by the hook engaging with the loop.

12. The boat of claim 1, wherein the strut includes a joint that is configured to allow the strut to move between at least a first position and a second position, the strut provides tension to the side shade cover when the joint is in the first position, and the strut does not provide tension to the side shade cover when the joint is in the second position.

13. The boat of claim 1, wherein the strut is a first strut, wherein the frame further includes at least a second strut having a first end and a second end, the first end of the second strut being configured to attach to the side shade cover, the second end of the second strut being configured to attach to one of the deck, the hull, the port gunwale, the starboard gunwale, the port side vertical support, or the starboard side vertical support, wherein the second strut provides tension to the side shade cover while the side shade cover extends outboard.

14. A shade assembly for a boat having a deck, comprising:

a top shade frame that is capable of attaching to the boat, the top shade frame including a port side vertical support capable of attaching to a port side of the boat and a starboard side vertical support capable of attaching to a starboard of the boat;

a top shade cover supported by the top shade frame and disposed directly above at least a portion of the deck of the boat when the top shade frame is attached to the boat; and a side shade cover supported by a side shade frame, the side shade cover being attached to the top shade such that the side shade cover extends outboard in a direction away from the top shade cover when the top shade frame is attached to the boat, the side shade frame including:

a center support strut having a first end and a second end, the first end of the center support strut being configured to attach to the side shade cover, the second end of the center support strut being capable of attaching to one of the boat, the port side vertical support, or the starboard side vertical support, wherein the center support strut provides tension to the side shade cover while the side shade cover extends outboard; and at least one lateral strut attached to the center support strut and the side shade cover, the lateral strut being configured to provide tension to the side shade cover for extending in one of an aft direction of the boat or a forward direction of the boat.

15. The shade assembly of claim 14, wherein the side shade cover includes an inboard edge and an outboard edge, and wherein the side shade cover is removably attached to the top shade cover by a fastener that couples the inboard edge of the side shade cover to the outboard edge of the top shade cover.

16. The shade assembly of claim 14, wherein the side shade cover is configurable to extend outboard at an angle relative to the top shade cover, the angle relative to the top shade cover being from 25° to 75°.

17. A boat comprising:

a bow and a stern;

a deck between the bow and the stern;

a longitudinal centerline extending from the bow to the stern dividing the deck into a port side and a starboard side;

a hull that surrounds the deck, the hull including a port gunwale and a starboard gunwale;

a top shade cover disposed directly above at least a portion of the deck and supported by a port side vertical support attached to the port gunwale and a starboard side vertical support attached to the starboard gunwale; and a side shade assembly attached to the boat on one of the port side of the deck and the starboard side of the deck, the side shade assembly including a frame and a side shade cover supported by the frame such that the side shade cover extends outboard beyond the deck in a direction away from the longitudinal centerline, wherein the frame includes:

a center support strut having a first end and a second end, the first end of the center support strut being configured to attach to the side shade cover, the second end of the center support strut being configured to attach to one of the deck, the hull, the port gunwale, the starboard gunwale, the port side vertical support, or the starboard side vertical support, wherein the center support strut provides tension to the side shade cover while the side shade cover extends outboard; and at least one lateral strut attached to the center support strut and the side shade cover, the lateral strut being configured to provide tension to the side shade cover for extending in one of an aft direction of the boat or a forward direction of the boat.

18. The boat of claim 17, wherein the side shade cover is configurable to extend beyond the deck at a downward angle relative to the deck, the downward angle relative to the deck being from 25° to 75°.

19. The boat of claim 17, further comprising a tower that supports the top shade cover, the tower having a port side vertical support and a starboard side vertical support, wherein the port side vertical support is attached to the port gunwale and the starboard side vertical support is attached to the starboard gunwale.

20. The boat of claim 19, wherein the second end of the center support strut is configured to attach to the tower.

* * * * *